US008004478B2

(12) United States Patent
Kim et al.

(10) Patent No.: US 8,004,478 B2
(45) Date of Patent: Aug. 23, 2011

(54) DISPLAY DEVICE AND METHOD OF DRIVING A DISPLAY DEVICE

(75) Inventors: Hak Su Kim, Seoul (KR); Young Jun Hong, Daegu (KR); Su Jin Baek, Geoje-shi (KR)

(73) Assignee: LG Display Co., Ltd., Seoul (KR)

( * ) Notice: Subject to any disclaimer, the term of this patent is extended or adjusted under 35 U.S.C. 154(b) by 1060 days.

(21) Appl. No.: 11/709,733

(22) Filed: Feb. 23, 2007

(65) Prior Publication Data

US 2008/0007496 A1 Jan. 10, 2008

(30) Foreign Application Priority Data

Jul. 6, 2006 (KR) ..... 10-2006-0063322
Jul. 6, 2006 (KR) ..... 10-2006-0063328

(51) Int. Cl.
*G09G 3/30* (2006.01)

(52) U.S. Cl. ..... 345/76

(58) Field of Classification Search ..... 348/672–675
See application file for complete search history.

(56) References Cited

U.S. PATENT DOCUMENTS

2001/0050662 A1* 12/2001 Kota et al. ..... 345/76
2005/0099367 A1* 5/2005 Kang et al. ..... 345/74.1

FOREIGN PATENT DOCUMENTS

JP 2003-262848 9/2003

* cited by examiner

*Primary Examiner* — Richard Hjerpe
*Assistant Examiner* — Carolyn R Edwards
(74) *Attorney, Agent, or Firm* — Morgan, Lewis & Bockius LLP

(57) ABSTRACT

An electroluminescent display device is provided that includes a panel having a plurality of scan lines, a plurality of data lines and a plurality of pixels formed at cross areas of the scan lines and data lines. A driving circuit may be provided to drive scan signals on the scan lines and data signals on the data lines. A frame control device may receive first display data, determine a total amount of current passing through each of the scan lines, and provide second display data to the panel based on the determined total amount of current.

22 Claims, 34 Drawing Sheets

S1 ⟶ PATTERN=Left, Frame rate=2, Frame level=2

S2 ⟶ PATTERN=Right, Frame rate=3, Frame level=1

S3 ⟶ PATTERN=Left, Frame rate=6, Frame level=1

S4 ⟶ PATTERN=Right, Frame rate=0, Frame level=0

[First frame]

[Second frame]

[Third frame]

S1 ⟶ Frame rate=2, Frame level=2

S2 ⟶ Frame rate=3, Frame level=1

S3 ⟶ Frame rate=6, Frame level=1

S4 ⟶ Frame rate=0, Frame level=0

[Fourth frame]

[Fifth frame]

[Sixth frame]

(1) Frame number : 4

(2) Frame rate : 4

(3) Frame level : 1

[Third frame]

[Fourth frame]

(1) Frame number : 4

(2) Frame rate : 2

(3) Frame level : 2

[First frame]

(1) Frame number : 8

(2) Frame rate : 4

(3) Frame level : 1

[Seventh frame]

[Eighth frame]

DISPLAY DEVICE AND METHOD OF DRIVING A DISPLAY DEVICE

This application claims priority from Korean Patent Application Nos. 2006-63322 and 2006-63328, filed on Jul. 6, 2006, the subject matters of which are incorporated herein by reference.

BACKGROUND

Field

Embodiments of the present invention may relate to a display device and a method of driving a display device. More specifically, embodiments of the present invention may relate to a display device that avoids, eliminates and/or diminishes a first line pattern, a cross-talk phenomenon and/or a second line pattern.

BRIEF DESCRIPTION OF THE DRAWINGS

Arrangements and embodiments may be described with reference to the following drawings in which like reference numerals refer to like elements and wherein.

DETAILED DESCRIPTION

Figure 1:
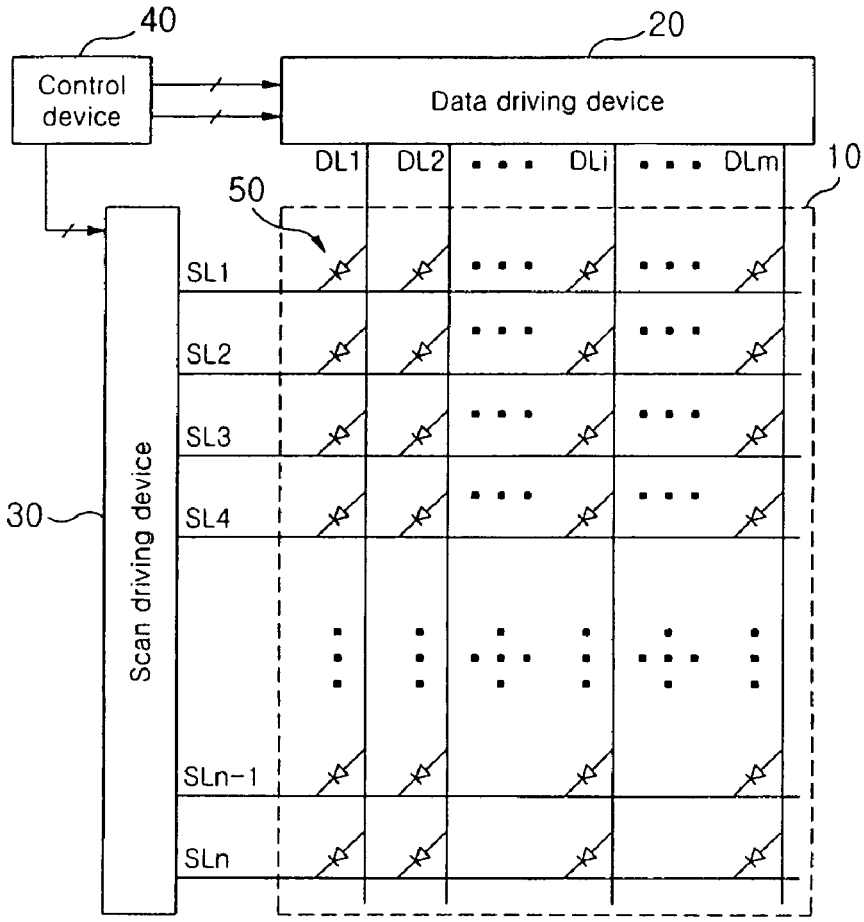
FIG. 1 is a block diagram of a display apparatus according to an example arrangement.

FIG. 1 is a block diagram of a display apparatus according to an example arrangement. Other arrangements may also be provided such as, for example, in U.S. Publication Nos. 2006/0262049, 2006/0146827, 2006/0139262, 2006/0055632, etc, whose entire disclosures are incorporated herein by reference. A display apparatus may be used in or formed as a rigid or flexible display for electronic books, newspapers, magazines, etc. The display apparatus may also be used in various types of portable devices (e.g., handsets, MP3 players, notebook computers, etc.), audio applications, navigation applications, televisions, monitors, or other types of devices that use a display, either monochrome or color.

FIG. 1 shows that the display apparatus may include a panel 10, a data driving device 20, a scan driving device 30 and a control device 40. The panel 10 may also include a plurality of pixels 50 formed in cross areas of data lines (DL1 to DLm) and scan lines (SL1 to SLn).

Figure 2:
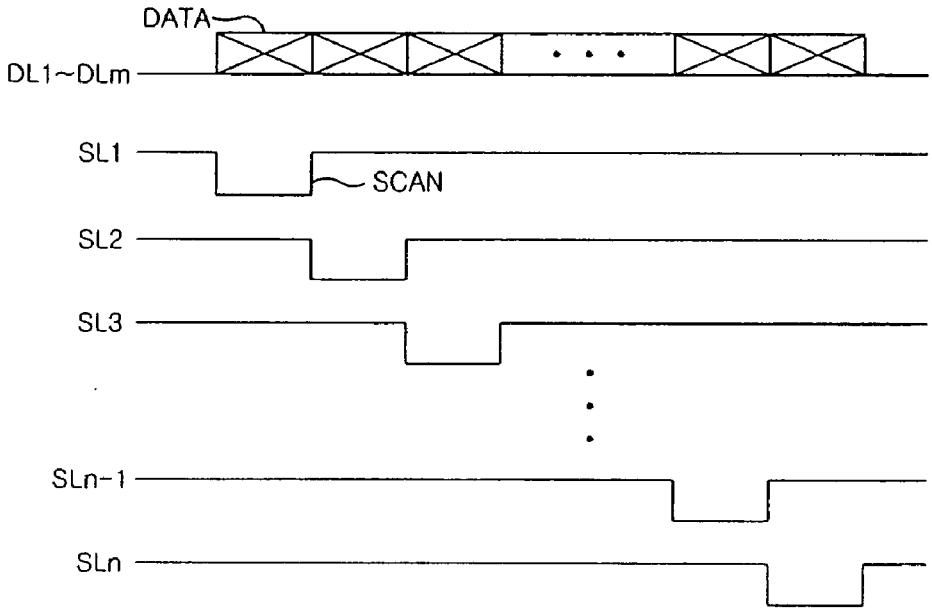
FIG. 2 is a timing diagram showing scan signals being applied to scan lines according to an example arrangement.

The scan driving device 30 may transmit scan signals in sequence to the scan lines (SL1 to SLn). The data driving device 20 may transmit data signals in sequence to the data lines (DL1 to DLm). The data driving device 20 may use a pulse amplitude modulation (PAM) method or a pulse width modulation (PWM) method, for example, to apply the data signals to the data lines (DL1 to DLm). For example, FIG. 2 is a timing diagram showing one example of scan signals being applied to the scan lines bit the scan driving device 30 and data signals being applied to the data lines by the data driving device 20.

Figure 3:
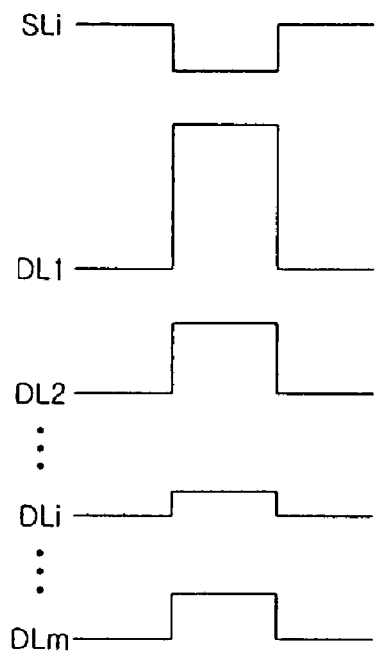
FIG. 3 is a timing diagram showing a method of driving a panel using a pulse amplitude modulation (PAM) method.

FIG. 3 is a timing diagram showing a method of driving the panel 10 using a PAM method. The data driving device 20 may apply data signals (i.e., data current corresponding to the digital video data) to the data lines (DL1 to DLm) by using the PAM method. In the PAM method, a gray scale of the pixels may be proportionate to an amplitude of the data current. In the data current, a time to have high logic may be constant irrespective of the gray scale corresponding to the digital video data. Other driving methods are disclosed in U.S. Publication Nos. 2005/0151707, 2006/0146827, etc., whose entire disclosures are incorporated herein by reference.

Figure 4:
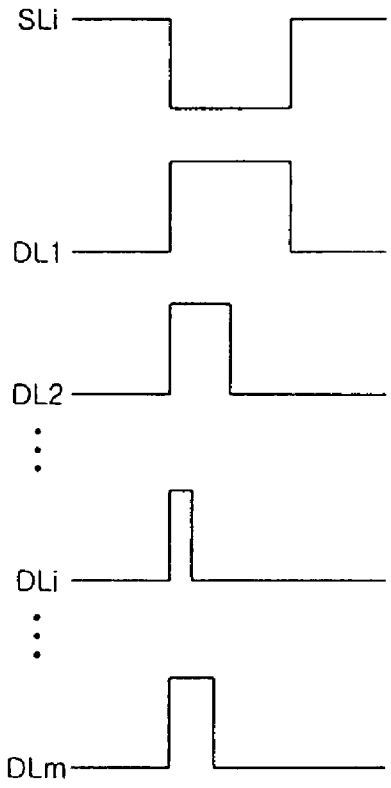
FIG. 4 is a timing diagram showing a method of driving a panel using a pulse width modulation (PWM) method.

FIG. 4 is a timing diagram showing a method of driving the panel 10 using a PWM method. The data driving device 20 may apply data signals (i.e., data current corresponding to the digital video data) to the data lines (DL1 to DLm) by using the PWM method. In the PWM method, a gray scale of the pixels may be proportionate to a time of high logic in the data current. The amplitude of the data current may be constant irrespective of the gray scale corresponding to the digital video data. Other driving methods are disclosed in U.S. Publication No. 2006/0146827, and U.S. Pat. Nos. 7,119,773, 6,914,388, etc., whose entire disclosures are incorporated herein by reference.

The data driving device 20 may use either a PAM current generating circuit and/or a PWM current generating circuit to drive the panel 10 depending on a gray scale level of an image signal as detected by the control device 40. When image signals having a relatively high gray scale level are to be displayed, the PAM method may be used to minimize power consumption. When image signals having a relatively low gray scale level are to be displayed, the PWM method may be used to ensure that good image quality is maintained. Other methods may also be used.

Figure 5:
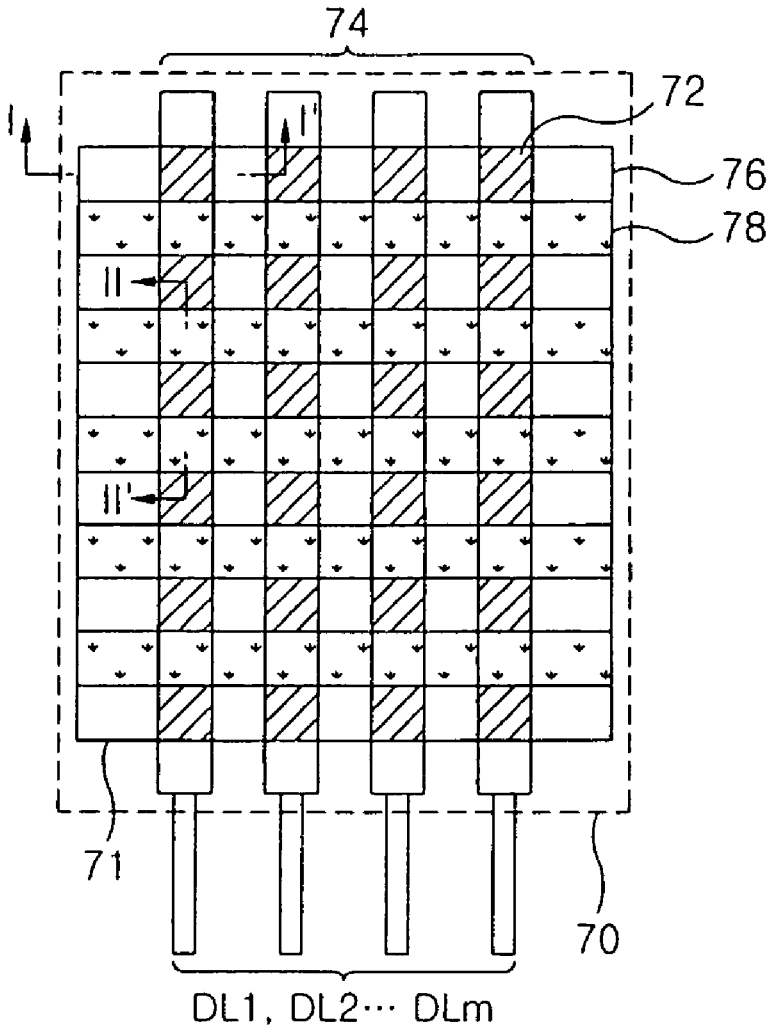
FIG. 5 shows a panel according to an example arrangement.

FIG. 5 shows a structure of the panel 10 according to an example arrangement. Other arrangements may also be used such as, for example, as illustrated in U.S. Pat. Nos. 7,122,956, 7,079,093, 7,106,006, etc., whose entire disclosures are incorporated herein by reference. More specifically, FIG. 5 shows a panel 70 corresponding to the panel 10 shown in FIG. 1. The panel 70 may include a cell section 71 containing a plurality of sub-pixels 72 (e.g., light emitting areas), anode electrode layers (or anode electrodes or data electrodes) 74, cathode electrode layers (or cathode electrodes or scan electrodes) 76 and walls 78. The sub-pixels 72 may be formed in cross areas of the anode electrode layers 74 and the cathode electrode layers 76.

The anode electrode layers 74 may serve as positive electrodes and the cathode electrode layers 76 may serve as negative electrodes. The walls 78 may be made of an insulating material to separate the cathode electrode layers 76 so that the cathode electrode layers 76 are not short-circuited.

The data lines DL1, DL2 . . . DLm may be conductors that are coupled to the anode electrode layers 74. Scan lines (not shown in FIG. 5) may be coupled to the cathode electrode layers 76. As one example, first scan lines may be connected to odd number cathode electrode layers and second scan lines may be connected to even number cathode electrode layers.

Figure 6:
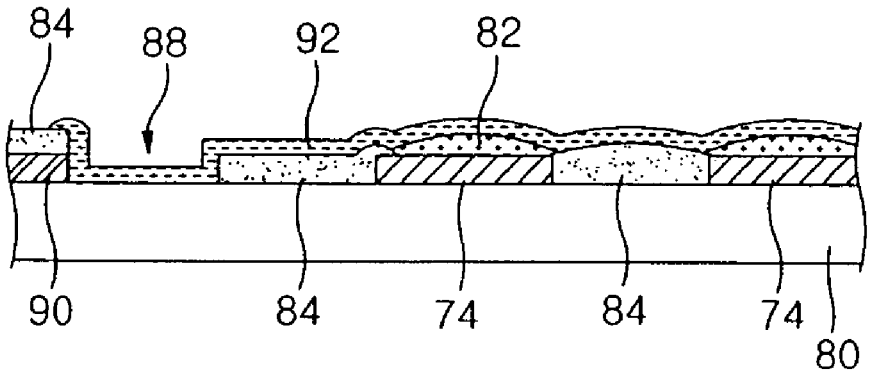
FIG. 6 is a side view of the panel according to an example arrangement.
Figure 7:
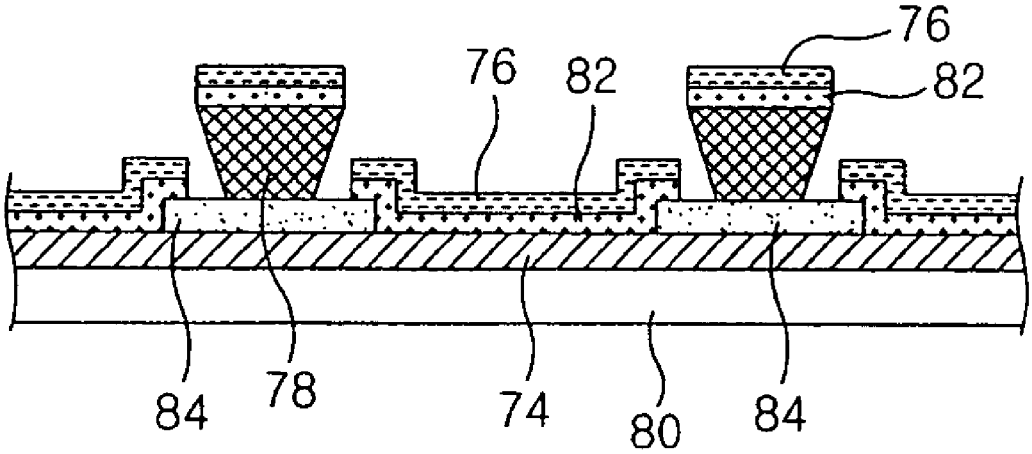
FIG. 7 is a side view of the panel according to an example arrangement.

FIGS. 6 and 7 are side views of an electroluminescent panel according to an example arrangement. More specifically, FIG. 6 is a sectional view taken along line I-I' of FIG. 5 and FIG. 7 is a sectional view taken along line II-II' of FIG. 5. Other arrangements may also be used.

FIG. 6 shows a substrate 80 having the anode electrode layers 74 and light emitting layer (or layers) 82 formed thereon in sequence. Each of the light emitting layers 82 may include an emitting layer made of organic or inorganic material corresponding to red, green or blue light.

An insulating layer 84 (or layers) may be formed on areas of the substrate 80 other than the light emitting areas and a contact hole section 88. The insulating layer 84 may prevent a short from occurring between the anode electrode layers 74. A scan line 90 may be connected to the contact hole section 88.

A metal layer 92 may be formed on the substrate 80 over the anode electrode layer 74, the insulating layer 84, the light emitting layer 82 and the scan line 90. The metal layer 92 may be connected to the scan line 90 through the contact hole section 88. The cathode electrode layer 76 (not shown in FIG. 6) may be connected to the scan line 90 through the contact hole section 88.

FIG. 7 shows that the anode electrode layer 74, the light emitting layer 82 and the cathode electrode layer 76 may be formed in sequence on the substrate 80. In addition, the insulating layer 84 and the wall 78 may be formed in sequence on the anode electrode layer 74.

Figure 8:
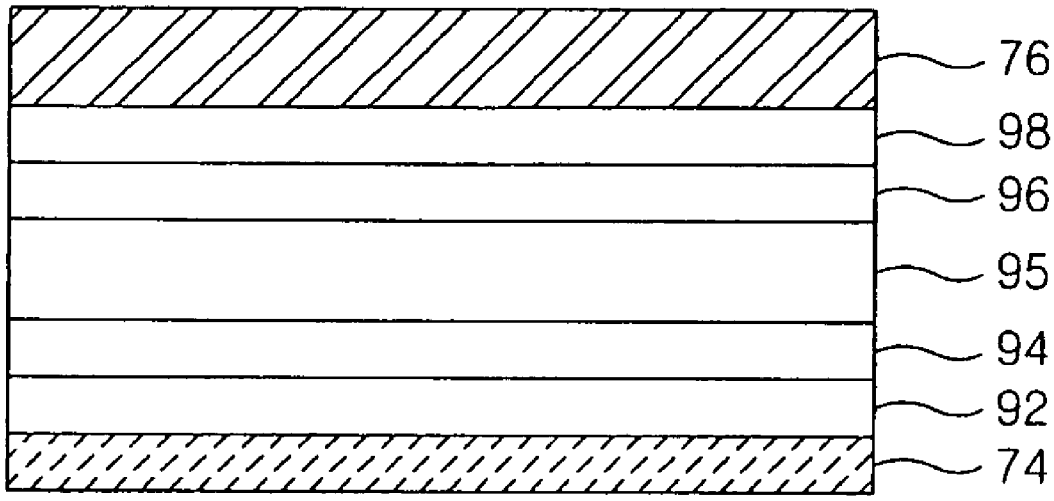
FIG. 8 shows an organic electroluminescent (EL) device according to an example arrangement.

FIG. 8 shows details of the light emitting device, e.g., an organic electroluminescent device, according to an example arrangement. Other arrangements may also be used such as, for example, as illustrated in U.S. Pat. Nos. 6,864,637, 7,142,179, 7,038,373, 7,023,013, etc., whose entire disclosures are incorporated herein by reference. The plurality of layers shown in FIG. 8 correspond to the light emitting layer 82 shown in FIGS. 6-7. More specifically, the device includes a hole injecting layer (HIL) 92 formed on the anode electrode 74, a hole transporting layer (HTL) 94 formed on the HIL 92, an organic electroluminescent layer 95 formed on the HTL 94, an electron transporting layer (ETL) 96 formed on the HTL 94 and an electron injecting layer (EIL) 98 formed on the ETL 96. The cathode electrode layer 76 may be formed on the ETL 96. One or more of the HIL, HTL, ETL and EIL may be omitted, depending on the particular device structure adopted. Further, an inorganic electroluminescent device may be used. Further, depending on the materials used for the cathode, anode and the substrate, the electroluminescent device can emit light through a transparent cathode, or through the transparent anode and substrate, or through both (bi-directional).

Figure 9:
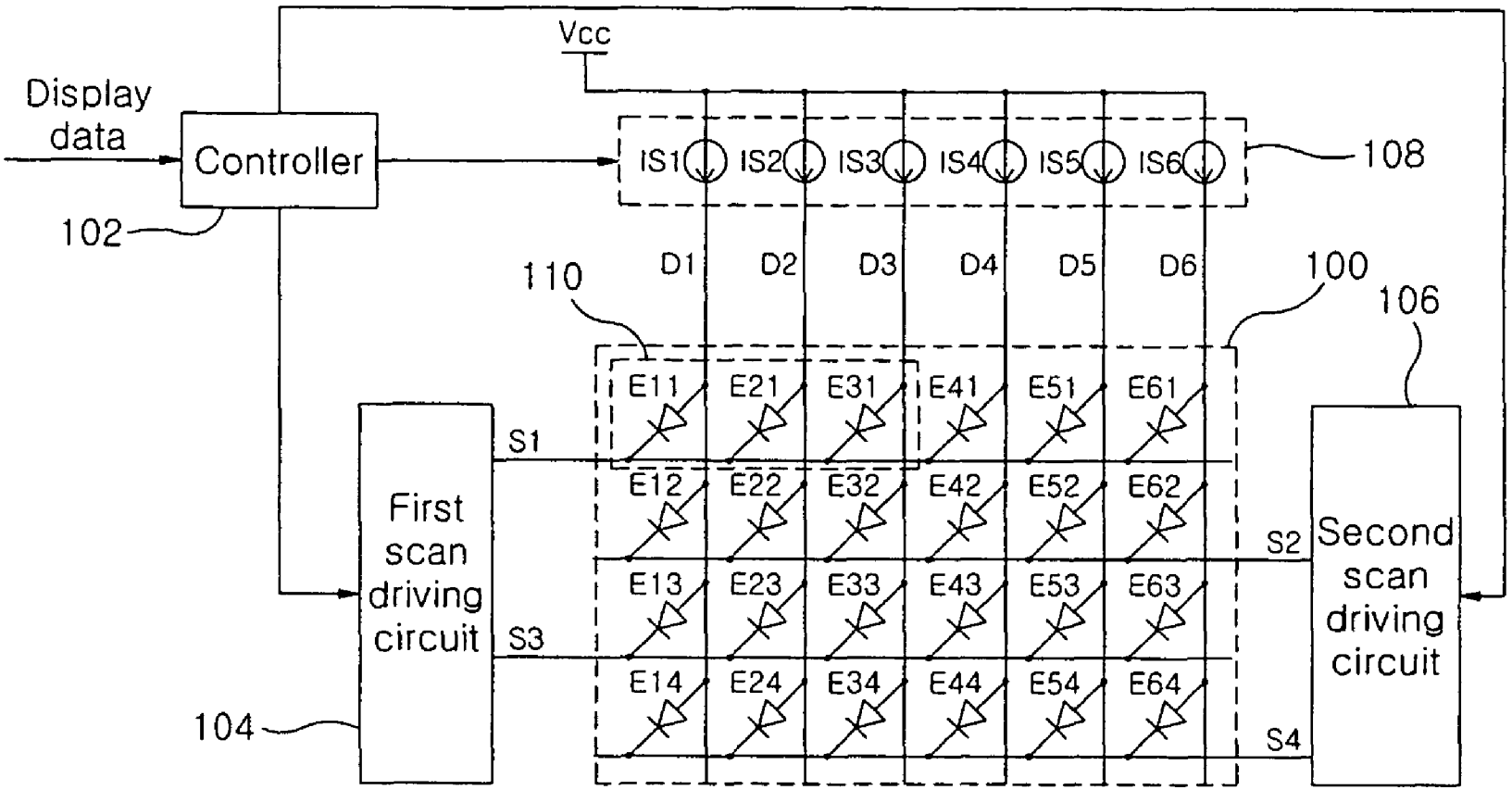
FIG. 9 is a view illustrating a display device according to an example arrangement.

FIG. 9 is a view illustrating a display device that may display an image according to an example arrangement. Other arrangements are also possible.

The display device shown in FIG. 9 may include a panel 100, a controller 102, a first scan driving circuit 104, a second scan driving circuit 106 and a data driving circuit 108.

The panel 100 mat include a plurality of sub-pixels E1 to E64 formed in cross areas of data lines D1 to D6 and scan lines S1 to S4. Three sub-pixels may form one pixel. For example, a pixel 110 may include one red sub-pixel E11, one green sub-pixel E21 and one blue sub-pixel E31.

The controller 102 may receive display data from an apparatus (not shown) outside of the display device. The controller 102 may control the scan driving circuits 104 and 106 and the data driving circuit 108 based on the received display data.

The first scan driving circuit 104 may transmit first scan signals to some of the scan lines S1 to S4 (e.g. S1 and S3). The second scan driving circuit 106 may transmit second scan signals to other scan lines S2 and S4.

The data driving circuit 108 may include a plurality of current sources IS1 to IS6. The data driving circuit 108 may provide data currents corresponding to the display data outputted from the current sources IS1 to IS6 to the data lines D1 to D6.

Figure 10A:
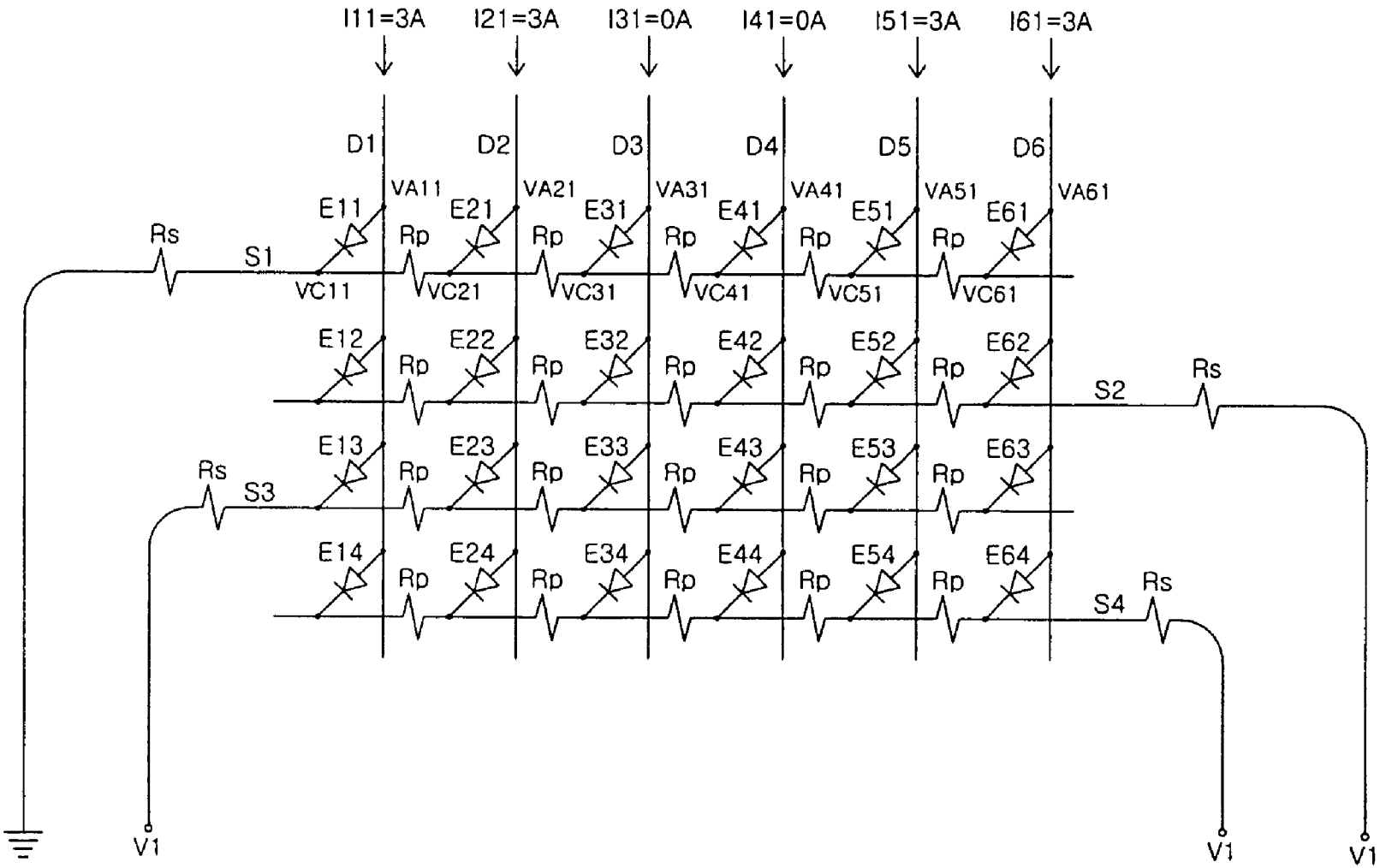
FIGS. 10A-10C are views illustrating a process of driving the display device in FIG. 9 according to an example arrangement.
Figure 10B:
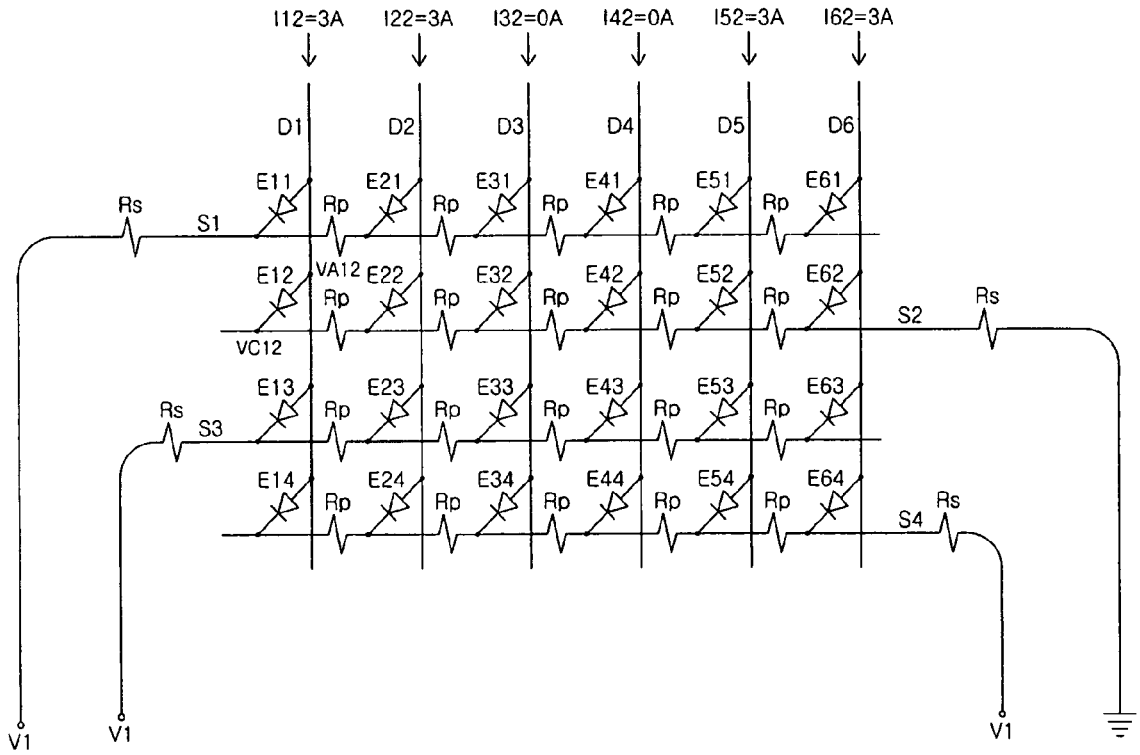
Figure 10C:
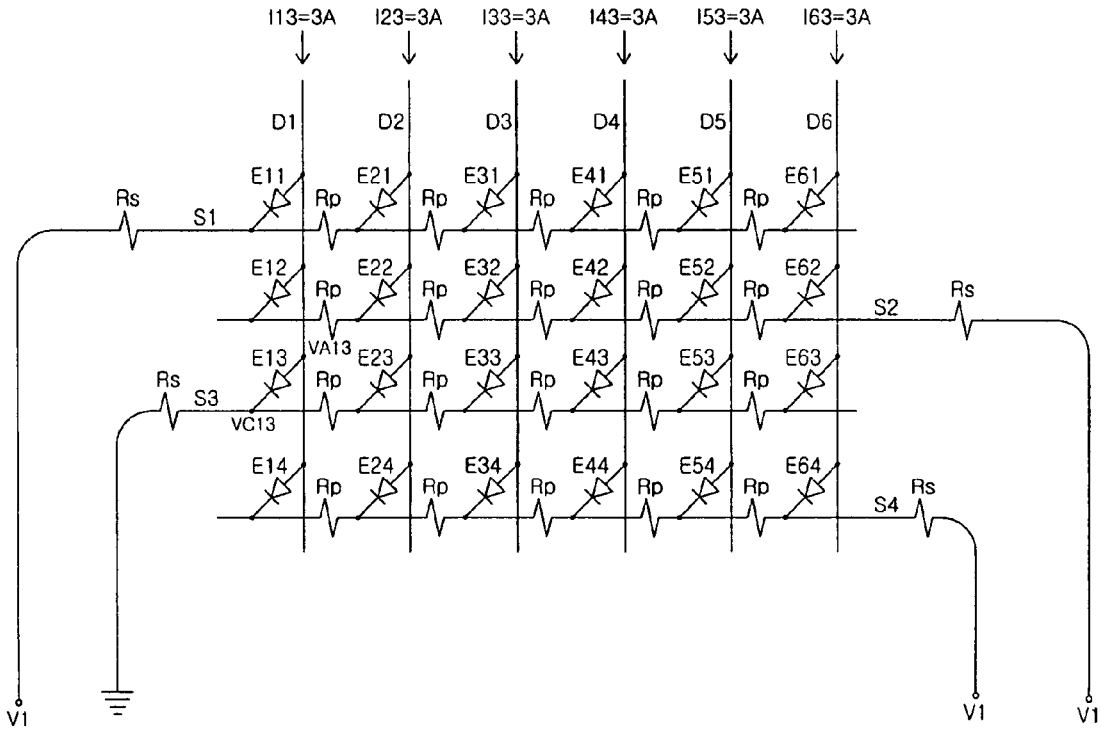
Figure 10D:
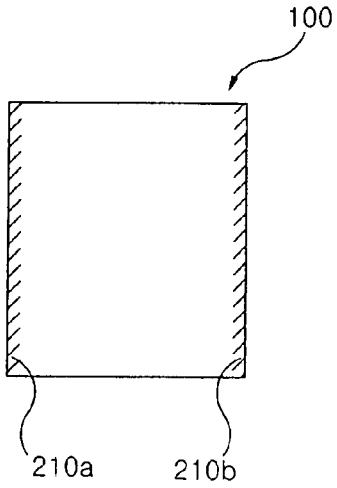
FIG. 10D is a view illustrating a panel in FIG. 9.

A process of driving the display device will now be described with reference to FIGS. 10A-10C. FIGS. 10A-10C are views illustrating a process of driving the display device of FIG. 9 according to one arrangement. FIG. 10D is a view illustrating a panel in FIG. 9 according to one arrangement. Other arrangements may also be provided As shown in FIG. 10A, a first scan line S1 is connected to ground and the other scan lines S2 to S4 are connected to a voltage source 71 that may have a same magnitude as a driving voltage (Vcc) of the display device.

Data currents I11 to I61 corresponding to first display data are provided to the data lines D1 to D6. The data currents I11 to I61 pass through the data lines D1 to D6, the sub-pixels E11 to E61 and the first scan line S1 to ground. As a result, the sub-pixels E11 to E61 related to the first scan line S1 may emit light.

As shown in FIG. 10B, a second scan line S2 may be connected to ground and the other scan lines S1, S3 and S4 may be connected to the voltage source V1.

Data currents I12 to I62 corresponding to second display data may be provided to the data lines D1 to D6 as shown in FIG. 10B. The second display data is inputted to the controller 102 after the first display data is inputted to the controller 102.

The data currents I12 to I62 pass through the data lines D1 to D6, the sub-pixels E12 to E62 and the second scan line S2 to ground. As a result, the sub-pixels E12 to E62 related to the second scan line S2 may emit light.

As shown in FIG. 10C, a third scan line S3 may be connected to ground and the other scan lines S1, S2 and S4 may be connected to the source V1.

Data currents I13 to I63 corresponding to third display data are provided to the data lines D1 to D6 as shown in FIG. 10C. The third display data is inputted to the controller 102 after the second display data is inputted to the controller 102. The data currents I13 to I63 pass through the data lines D1 to D6, the sub-pixels E13 to E63 and the third scan line S3 to ground. The sub-pixels E13 to E63 related to the third scan line S3 may emit light.

Sub-pixels E14 to E64 related to a fourth scan line S4 may emit light through a similar type of method.

The above process of emitting light in the pixels E11 to E64 may be repeated over a frame unit (i.e., using the scan lines S1 to S4).

The brightness difference of the sub-pixels E11, E12 and E13 will now be described. Brightness of a sub-pixel may be affected by a cathode voltage of the sub-pixel (i.e., a corresponding data current) and a resistance corresponding to the sub-pixel. Resistances between each of the sub-pixels E11 and E64 and ground will now be described.

In FIGS. 10A-10C, a resistance between the sub-pixel E11 and ground corresponds to Rs, a resistance between the sub-pixel E21 and ground corresponds to Rs+Rp, and a resistance between the sub-pixel E31 and ground corresponds to Rs+2Rp. In addition, a resistance between the sub-pixel E41 and ground corresponds to Rs+3Rp, a resistance between the sub-pixel E51 and ground corresponds to Rs+4Rp, and a resistance between the sub-pixel E61 and ground corresponds to Rs+5Rp. Additionally, a resistance between the sub-pixel E12 and ground corresponds to Rs+5Rp.

The brightness difference of the sub-pixels E11 and E12 will now be described. In this example, the data currents I11 to I61 are 3 A, 3 A, 0 A, 0 A, 3 A and 3 A and the data currents 112 to 162 are 3 A, 3 A, 0 A, 0 A, 3 A and 3 A. The sum of the data currents I11 to I61 passing through the first scan line S1 is identical to the sum of the data currents I12 to I62 passing through the second scan line S2.

A cathode voltage may be determined based on a resistance between a corresponding sub-pixel and ground times an amount of current passing through the corresponding scan line. Accordingly, a cathode voltage VC11 of the sub-pixel E11 is 12 A(3 A+3 A+0 A+0 A+3 A+3 A)×Rs as shown in FIG. 10A, a cathode voltage VC21 of the sub-pixel E21 is 12 A(3 A+3 A+0 A+0 A+3 A+3 A)×Rs+9 A(3 A+0 A+0 A+3 A+3 A)×Rp, and a cathode voltage VC31 of the sub-pixel E31 is 12 A(3 A+3 A+0 A+0 A+3 A+3 A)×Rs+9 A(3 A+0 A+0 A+3 A+3 A)×Rp+6 A(0 A+0 A+3 A+3 A)×Rp.

Further, a cathode voltage VC41 of the sub-pixel E41 is 12 A(3 A+3 A+0 A+0 A+3 A+3 A)×(Rs)+9 A(3 A+0 A+0 A+3 A+3 A)×Rp+6 A(0 A+0 A+3 A+3 A)×Rp+6 A(0 A+3 A+3 A)×Rp, a cathode voltage VC51 of the sub-pixel E51 is 12 A(3 A+3 A+0 A+0 A+3 A+3 A)×Rs+9 A(3 A+0 A+0 A+3 A+3 A)×Rp+6 A(0 A+0 A+3 A+3 A)×Rp+6 A(0 A+3 A+3 A)×Rp+6 A(3 A+3 A)×Rp, and a cathode voltage VC 61 of the sub-pixel E61 is 12 A(3 A+3 A+0 A+0 A+3 A+3 A)×Rs+9 A(3 A+0 A+0 A+3 A+3 A)×Rp+6 A(0 A+0 A+3 A+3 A)×Rp+6 A(0 A+3 A+0 A)×Rp+6 A(3 A+3 A)×Rp+3 A×Rp.

In addition, a cathode voltage VC12 of the sub-pixel E12 is 12 A(3 A+3 A+0 A+0 A+3 A+3 A)×(Rs)+9 A(3 A+0 A+0 A+3 A+3 A)×Rp+6 A(0 A+0 A+3 A+3 A)×Rp+6 A(0 A+3 A+3 A)×Rp+6 A(3 A+3 A)×Rp+3 A×Rp.

Since the cathode voltage VC12 of the sub-pixel E12 is higher than the cathode voltage VC11 of the sub-pixel E11, and the data currents I11 and I12 having a same magnitude are provided to the sub-pixels E11 and E12, the sub-pixel E12 may emit light having a lower brightness than the sub-pixel E11. This is because the higher a cathode voltage, the darker that corresponding sub-pixel emits. That is though the data currents I11 and I12 having a same magnitude are provided to the data line D1 so that the sub-pixels E11 and E12 have a same brightness, the sub-pixel E12 emits light having a lower brightness than the sub-pixel E11 due to a difference of corresponding resistances. In particular, the sub-pixels E11 and E12 and the sub-pixels E61 and E62 of the sub-pixels E11 to E62 related to the scan lines S1 and S2 have a bigger brightness difference among the sub-pixels. As a result, line patterns may occur between the sub-pixels E11 and E12 and line patterns may occur between the sub-pixels E61 and E62. This pattern may be referred to as a first line pattern (or line pattern). In other words, the first line pattern may occur between the sub-pixels related to outermost data lines D1 and D6 of the data lines D1 to D6.

The brightness differences of the sub-pixels E11 and E13 will now be described. In this example, the data currents I11 to I61 are 3 A, 3 A, 0 A, 0 A, 3 A and 3 A, and the data currents I13 to I63 are 3 A, 3 A, 3 A, 3 A, 3 A and 3 A.

The cathode voltage VC11 of the sub-pixel E11 is 12 A(3 A+3 A+0 A+0 A+3 A+3 A)×Rs, and a cathode voltage VC13 of the sub-pixel E13 is 18 A(3 A+3 A+3 A+3 A+3 A+3 A)×Rs. That is, the cathode voltage VC13 of the sub-pixel E13 is higher than the cathode voltage of the sub-pixel E11. The sub-pixel E13 therefore emits light having a lower brightness than the sub-pixel E11. Accordingly, though the data currents I11 and I13 having a same magnitude are provided to the data line D1 so that the sub-pixels E11 and E13 have a same brightness, the sub-pixel E11 emits light having a higher brightness than the sub-pixel E13 due to a difference in the total amount of current passing through the corresponding scan lines. This may be referred to as a cross-talk phenomenon.

The brightness of the sub-pixels E11 to E16 and E61 to E66 related to the outermost data lines D1 to D6 may be compared with the brightness of the sub-pixels E21 to E56 related to the other scan lines D2 to D5.

Some sub-pixels may be disposed at left and right sides of each of the sub-pixels E21 and E56 related to the data lines D2 to D5 and the brightness of the sub-pixels E21 to E56 may be neutralized due to the disposed sub-pixels.

However, no sub-pixel may be disposed at left or right sides of the sub-pixels E11 to E16 and E61 to E66 related to the outermost data lines D1 and D6, and so the brightness of the sub-pixels E11 to E16 and E61 to E66 may not be neutralized. As a result, the sub-pixels E11 to E16 and E61 to E66 related to the outermost data lines D1 and D6 may emit light having a higher brightness than the sub-pixels E21 to E56 related to the other data lines D2 to D6. A red line pattern 210A and a blue line pattern 210B may occur at left and right areas of the panel 100 as shown in FIG. 10D. This line pattern may be referred to as a second line pattern.

Figure 11A:
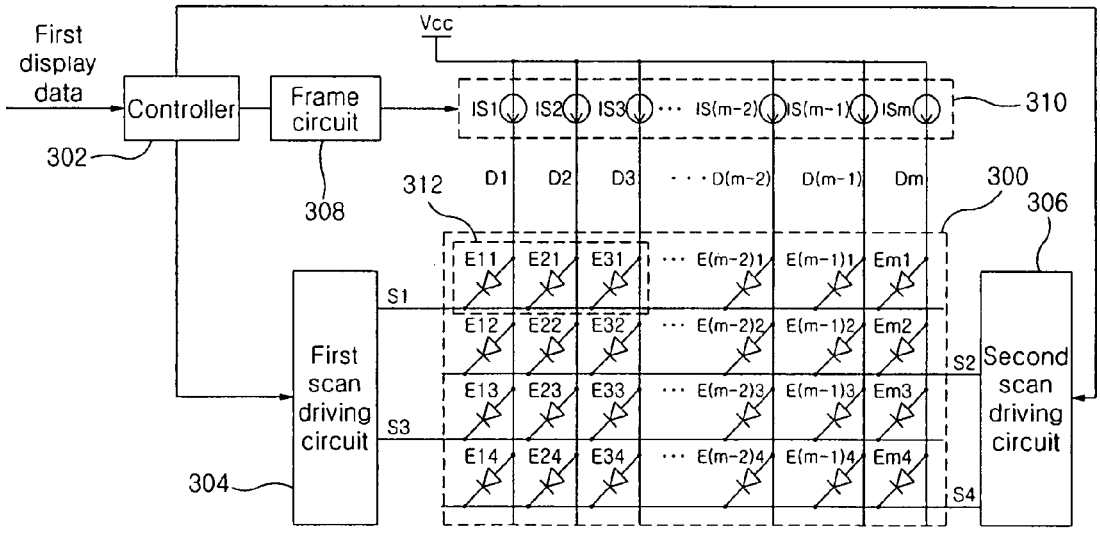
FIG. 11A is a view illustrating a display device according to an example embodiment of the present invention.
Figure 11B:
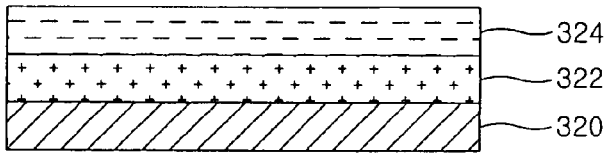
FIG. 11B is a sectional view illustrating a sub-pixel of FIG. 11A.

FIG. 11A is a view illustrating a display device according to an example embodiment of the present invention. FIG. 11B is a sectional view illustrating a sub-pixel of FIG. 11A. Other embodiments and configurations are also within the scope of the present invention.

As shown in FIG. 11A, the light emitting device may include a panel 300 and a driver. The driver may include a controller 302, a first scan driving circuit 304, a second scan driving circuit 306, a frame circuit 308 and a data driving circuit 310.

The display device may include an organic electroluminescent device, a plasma display panel and/or a liquid crystal display, for example. As one example, the organic electroluminescent device will hereafter be described.

The panel 300 to display an image may include a plurality of sub-pixels E11 to Em4 formed in cross areas of data lines D1 to Dm and scan lines S1 to S4. One pixel may include three sub-pixels. For example, a pixel 312 may be composed of one red sub-pixel for emitting a red light, one green sub-pixel for emitting a green light and one blue sub-pixel for emitting a blue light. The pixel 312 may emit various colors of lights by combining the sub-pixels.

In another example, one pixel may be made up of one red sub-pixel, one green sub-pixel, one blue sub-pixel and one white sub-pixel for emitting a white light.

In addition, when the display device is an organic electroluminescent device, at least one of the sub-pixels E11 to Em4 may include a first electrode layer 320, an organic layer 322, and a second electrode layer 324 disposed in sequence on a substrate (not shown) as shown in FIG. 11B. Other structures for the organic electroluminescent device are also within the scope of the present invention.

One of the electrode layers 320 and 324 may be a positive electrode and the other electrode layer may be a negative electrode. For example, the first electrode layer 320 corresponding to the positive electrode may be made of indium tin oxide and the second electrode layer 324 corresponding to the negative electrode may be made of aluminum (Al).

The organic layer 322 may include an emitting layer (EML) made of an organic material.

When a positive voltage and a negative voltage are provided to the electrode layers 320 and 324, holes and electrons generated from the electrode layers 320 and 324 may be combined in the EML to form excitons. The excitons may become decomposed and a light having a certain wavelength may be emitted from the EML during the decomposition process.

When scan signals are transmitted to the scan lines S1 to S4 and data currents are provided to the data lines D1 to Dm, the sub-pixels E11 to Em4 may emit light. The sub-pixels E11 to Em4 may form one pixel 312 having 3 sub-pixels as shown in FIG. 11A. That is, the pixel 312 may be composed of red sub-pixel E11, green sub-pixel E21 and blue sub-pixel E31. The red sub-pixel E11 may include an organic layer made of organic material corresponding to red light, and the green sub-pixel E21 may include an organic layer made of organic material corresponding to green light. Additionally, the blue sub-pixel E31 may include an organic layer made of organic material corresponding to blue light.

The controller 302 may receive first display data from an apparatus (not shown) located outside of the display device. The controller 302 (or memory) may store the received first display data. The controller 302 may transmit the received first display data to the frame circuit 308.

The first scan driving circuit 304 may transmit first scan signals to some of the scan lines S1 to S4 (e.g. S1 and S3). The second scan driving circuit 306 may transmit second scan signals to the other scan lines (e.g., S2 and S4).

The frame circuit 308 may detect the total amount of current passing through each of the scan lines S1 to S4 for a unit of N (an integer of 2 or more) frames. In one embodiment, the frame circuit 308 may detect a total amount of current of the first display data transmitted from the controller 302. The frame circuit 308 may adjust levels of the first display data based on the detected result, thereby generating second display data. One frame may correspond to one screen displayed on the panel 300. The scan lines S1 to S4 may be selected once for each frame by the scan signals and the sub-pixels E11 to Em4 related to the scan lines S1 to S4 may emit light once for every frame. Operations of the frame circuit 308 will now be described with reference to the accompanying drawings.

The data driving circuit 310 may include a plurality of current sources IS1 to ISm that may provide data currents corresponding to the second display data to the data lines D1 to Dm. As a result, the sub-pixels E11 to Em4 may emit light.

Figure 12A:
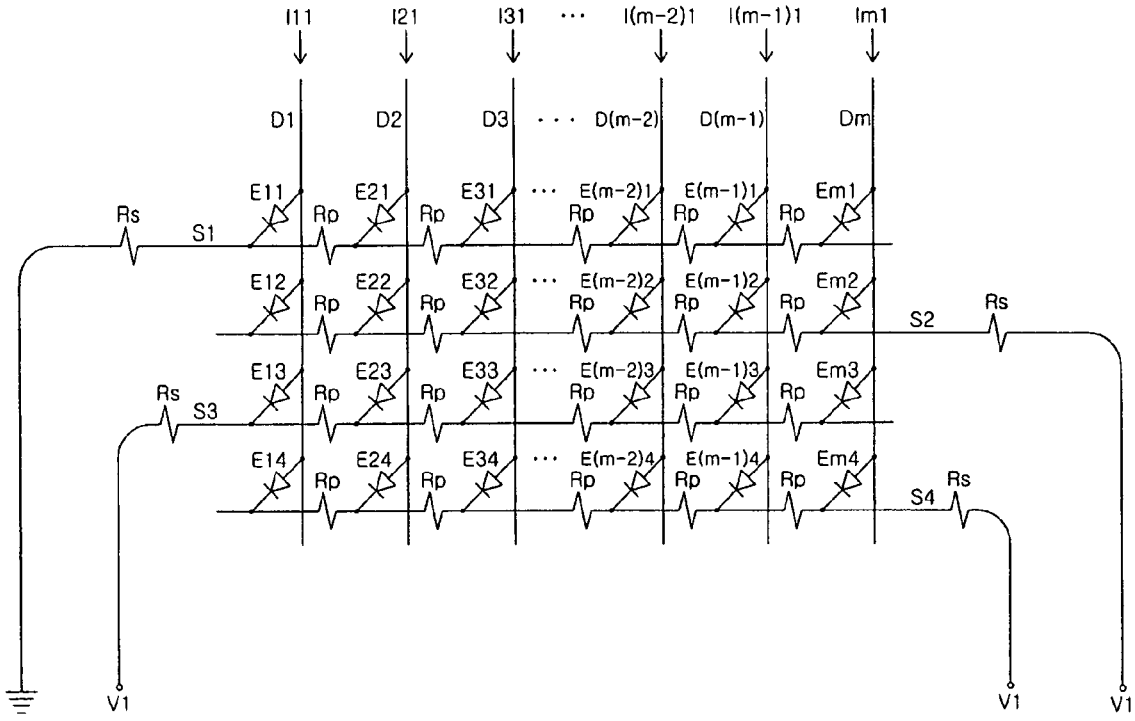
FIGS. 12A-12C are views illustrating a process of driving the display device of FIG. 11A.
Figure 12B:
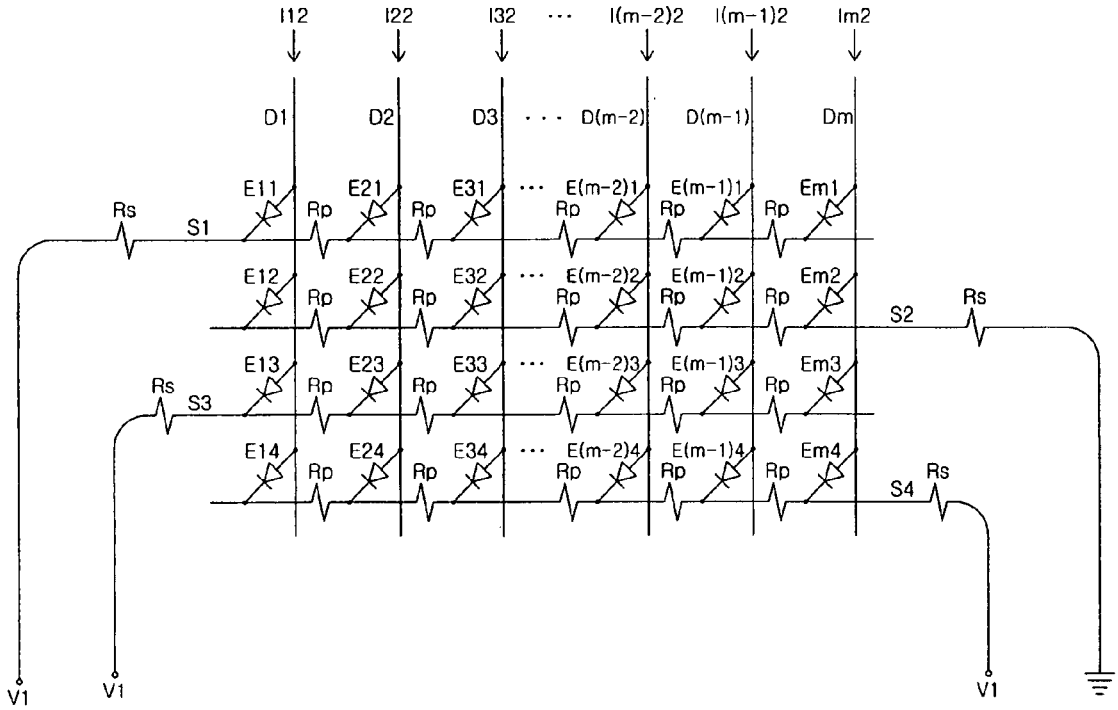
Figure 12C:
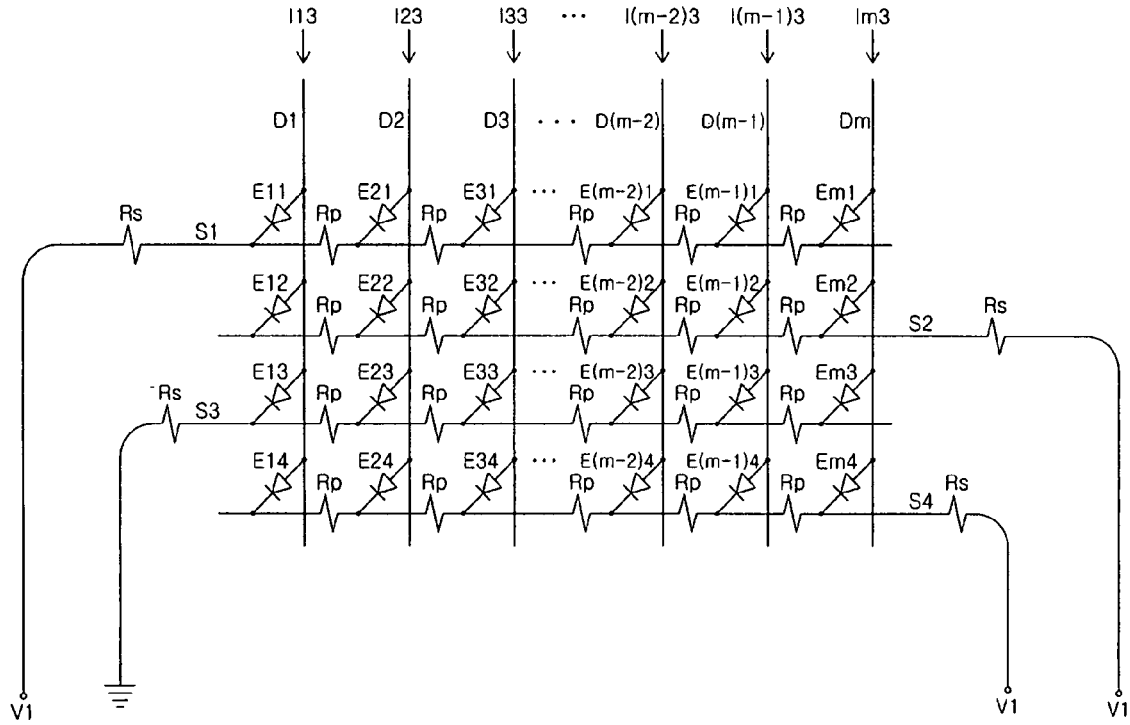

A process of driving the display device will now be described with reference to FIGS. 12A-12C. FIGS. 12A-12C are views illustrating a process of driving the display device of FIG. 11A. As shown in FIG. 12A, the first scan line S1 may be coupled to a first source (e.g., ground) and the other scan lines S2 to S4 may be coupled to a second source V1 such as a voltage source having a same magnitude as a driving voltage (Vcc) of the display device.

Data currents I11 to Im1 corresponding to second display data generated from the frame circuit 308 may be provided to the data lines D1 to Dm. The data currents I11 to Im1 may pass through the data lines D1 to Dm, the sub-pixels E11 to Em1, and the first scan line S1 to the first source. Thus, the sub-pixels E11 to Em1 related to the first scan line S1 may emit light.

The second scan line S2 may subsequently be coupled to the first source and the other scan lines S1, S3 and S4 may be coupled to the second source.

Data currents I12 to Im2 corresponding to second display data generated from the frame circuit 308 may be provided to the data lines D1 to Dm as shown in FIG. 12B. The data currents I12 to Im2 may be provided through the data lines D1 to Dm, the sub-pixels E12 to Em2 and the second scan line S2 to the first source. The sub-pixels E12 to Em2 related to the second scan line S2 may emit light.

The third scan line S3 may subsequently be coupled to the first source and the other scan lines S1, S2 and S4 may be coupled to the second source.

Data currents I13 to Im3 corresponding to second display data generated from the frame circuit 308 may be provided to the data lines D1 to Dm as shown in FIG. 12C. The data currents I13 to Im3 may be provided through the data lines D1 to Dm, the sub-pixels E13 to Em3 and the third scan line S3 to the first source. The sub-pixels E13 to Em3 related to the third scan line S3 may emit light.

Sub-pixels E14 to Em4 corresponding to the fourth scan line S4 may also emit light through a similar type of method. The above process of emitting light in the sub-pixels E11 to Em4 may be repeated for a unit of a frame (i.e., using the scan lines S1 to S4).

The display device may convert first display data inputted from an apparatus external to the display device into second display data so that the first line pattern and cross-talk phenomenon do not occur (or do not substantially occur) to the panel 300. The level of the first display data may be lowered to generate the second display data and have the sub-pixels E11 to Em4 emit light using the generated second display data. This converting process will now be described in detail.

Figure 13A:
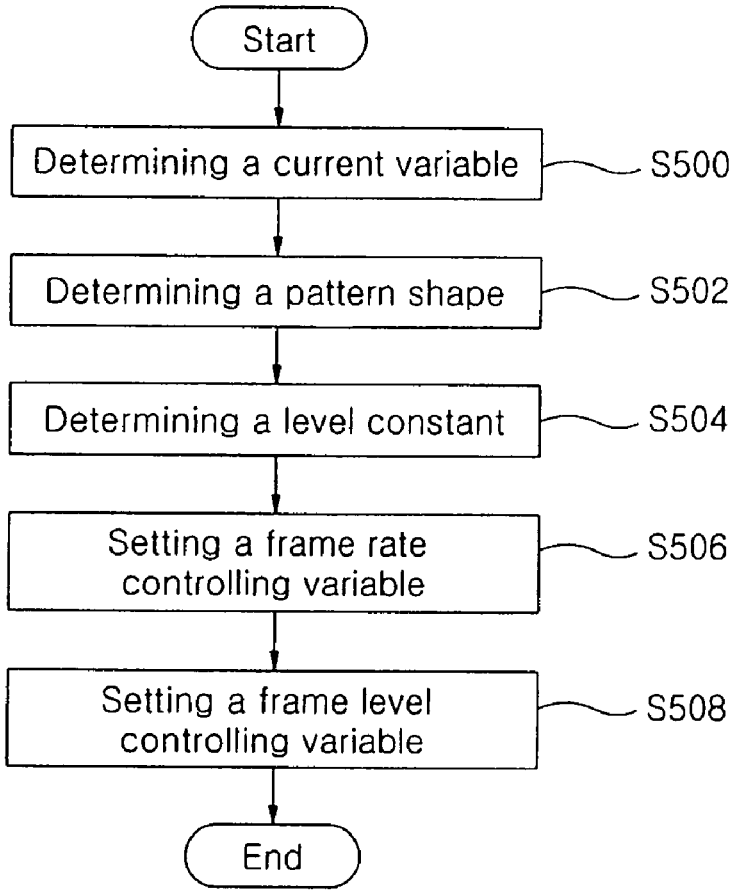
FIG. 13A is a flow chart illustrating a process of setting variables for preventing the first line pattern according to an example embodiment of the present invention.
Figure 13B:
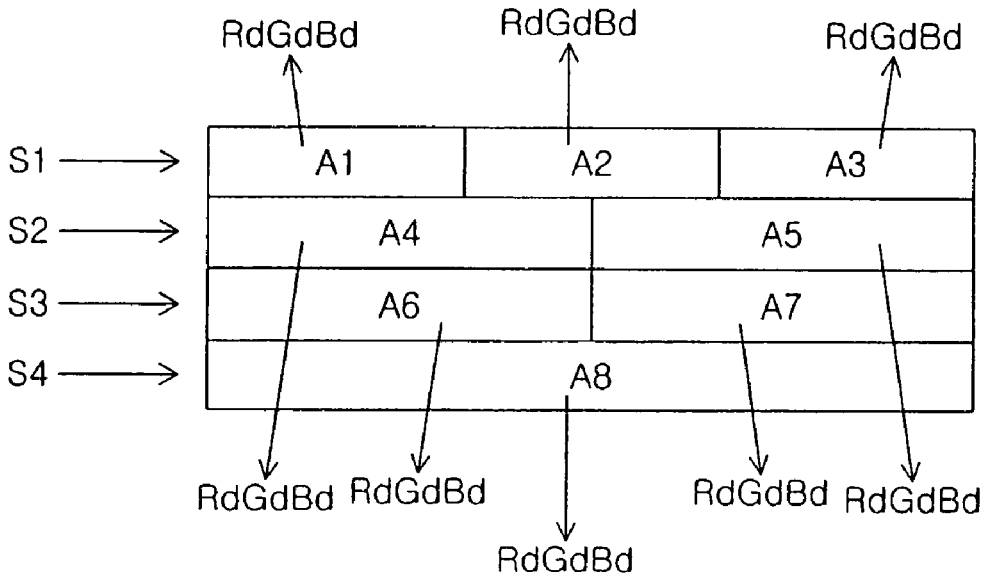
FIG. 13B is a plan view illustrating a screen structure of a panel in accordance with the variables.

FIG. 13A is a flow chart illustrating a process of setting variables for preventing a first line pattern according to an example embodiment of the present invention. FIG. 13B is a plan view illustrating a screen structure of a panel in accordance with the variables. Other embodiments, configurations, operations and orders of operation are also within the scope of the present invention.

As shown in FIG. 13A, in operation S500 the display device may add currents passing through each of the scan lines S1 to S4 for a predetermined number of frames (e.g. 8 frames) so as to calculate a total amount of current corresponding to each of the scan lines S1 to S4. The display device may then determine a current variable based on the total amount of current. For example, a total amount of current passing through the first scan line S1 during 8 frames may be calculated based on a sum of current passing through the first scan line S1 in a first frame to an eighth frame.

In operation S502, the frame circuit 308 may determine a pattern shape based on the total amount of current corresponding to each of the scan lines S1 to S4. For example, when the brightness difference of sub-pixels related to one scan line (e.g. first scan line S1) is high because the total amount of current corresponding to the first scan line S1 is high, then the area corresponding to the first scan line S1 of the panel 300 may be divided into several sub-areas A1 to A3 as shown in FIG. 13B. However, when the brightness difference of sub-pixels related to one scan line (e.g. scan line S2 or scan line S4) is small because the total amount of current corresponding to the scan line is small, the area corresponding to the scan line of the panel 300 may be divided into only a few sub-areas (e.g. A4 and A5) or the area may not be divided at all.

In operation S504, a level constant may be determined based on the total amount of current and the pattern shape. The first line pattern may occur based on a brightness difference between sub-pixels related to neighboring scan lines as discussed above. Accordingly, to reduce the brightness of the sub-pixel having a higher brightness among sub-pixels related to the neighboring scan lines, the display device may lower the level of the first display data to generate second display data, and then provide data current corresponding to the second display data to the sub-pixel. As a result, the sub-pixels may have a same (or similar) brightness. The display device may not compensate the brightness difference of the sub-pixels for one frame, but rather may compensate the brightness difference of the sub-pixels for a plurality of frames. This may be because human beings do not detect an image displayed on the panel 300 for one frame due to visual characteristics, but rather detect the image for a unit of a plurality of frames. For example, when the sub-pixels have 3 levels of brightness differences during 8 frames, then the display device may set the level constant to 3 so that the brightness of the sub-pixel having the higher brightness in the sub-pixels may be lowered by 3 levels during the 8 frames.

In operation S506, a variable controlling frame rate may be set and a variable controlling frame level controlling variable may be set in operation S508. This will be described in detail with reference to FIGS. 14A-14I.

FIGS. 14A-14I are views illustrating a process of preventing a first line pattern according to an example embodiment of the present invention. Other embodiments are configurations are also within the scope of the present invention.

Figures 14A, 14B:
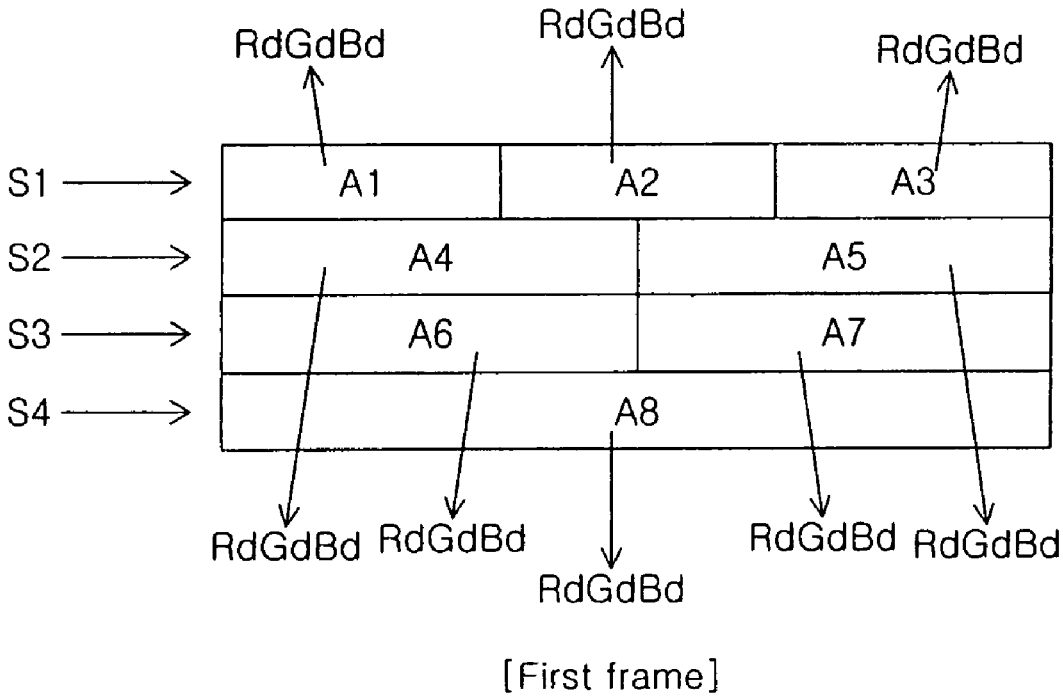
FIGS. 14A-14I are views illustrating a process of preventing the first line pattern according to an example embodiment of the present invention.

Variables as shown in FIG. 14A may be set so that the first line pattern may be prevented (i.e., sub-pixels related to neighboring scan lines having a same brightness) or substantially reduced/minimized.

Variables related to the first scan line S1 will now be described. The frame circuit 308 may determine a pattern as shown in FIG. 14B based on the total amount of current corresponding to the first scan line S1. The area corresponding to the first scan line S1 may be divided into sub-areas A1, A2 and A3.

Subsequently, a pattern, a frame rate and a frame level may be set with reference to the total amount of current and the resistance corresponding to the first scan line S1 as will be described below.

The first scan line S1 may be disposed to the left of the panel 300, and the resistance corresponding to the sub-area A1 may be smaller than the resistance corresponding to the sub-areas A2 and A3. Accordingly, when data currents having a same magnitude are provided to the sub-areas A1 to A3, the sub-area A1 may emit a light having a higher brightness than the sub-areas A2 and A3. Therefore, a pattern is set to left and the brightness levels are low in an order of the sub-areas A1, A2 and A3.

Figure 14C:
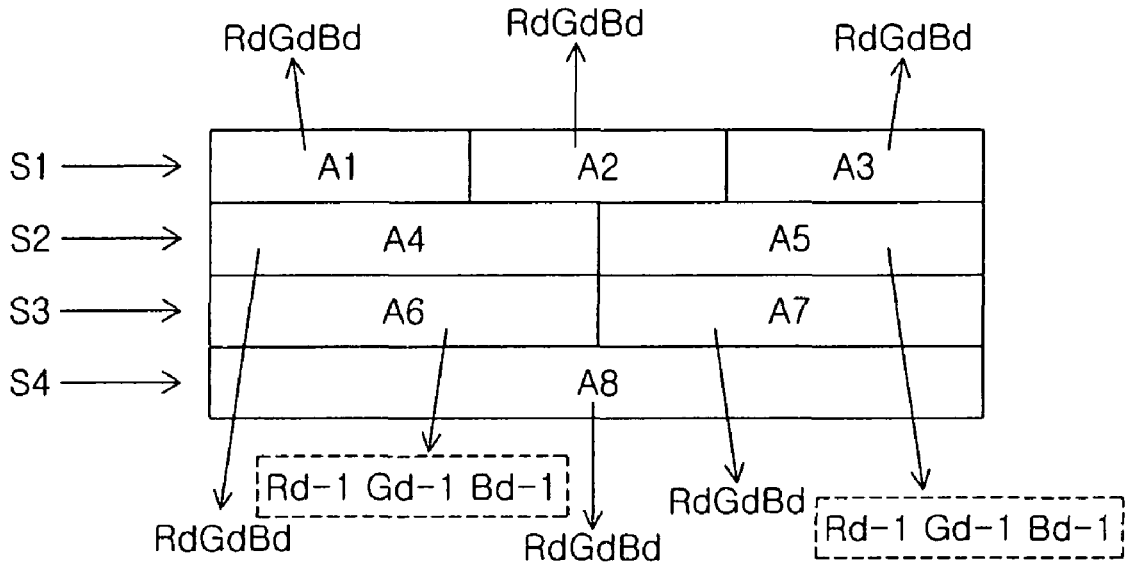
Figure 14D:
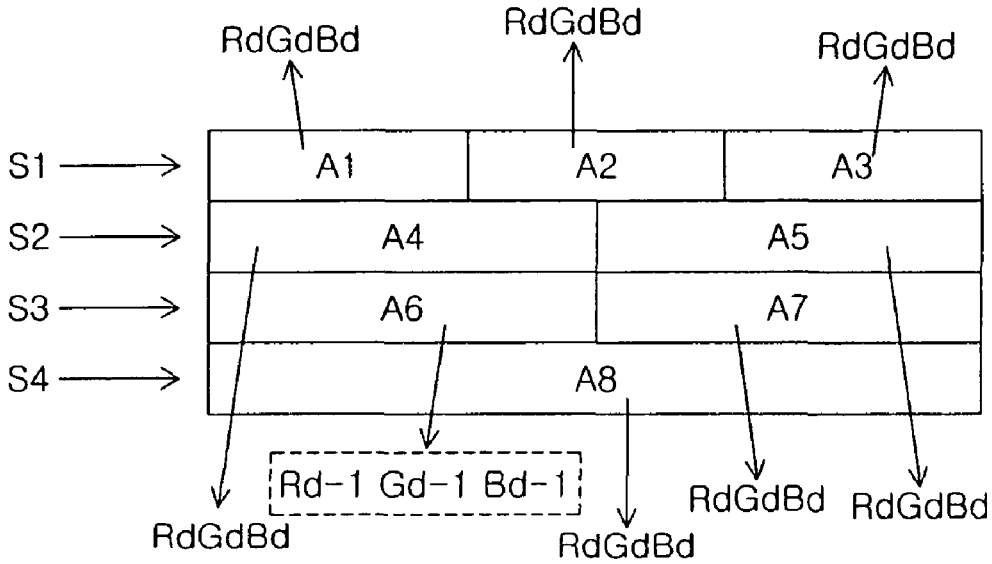
Figure 14E:
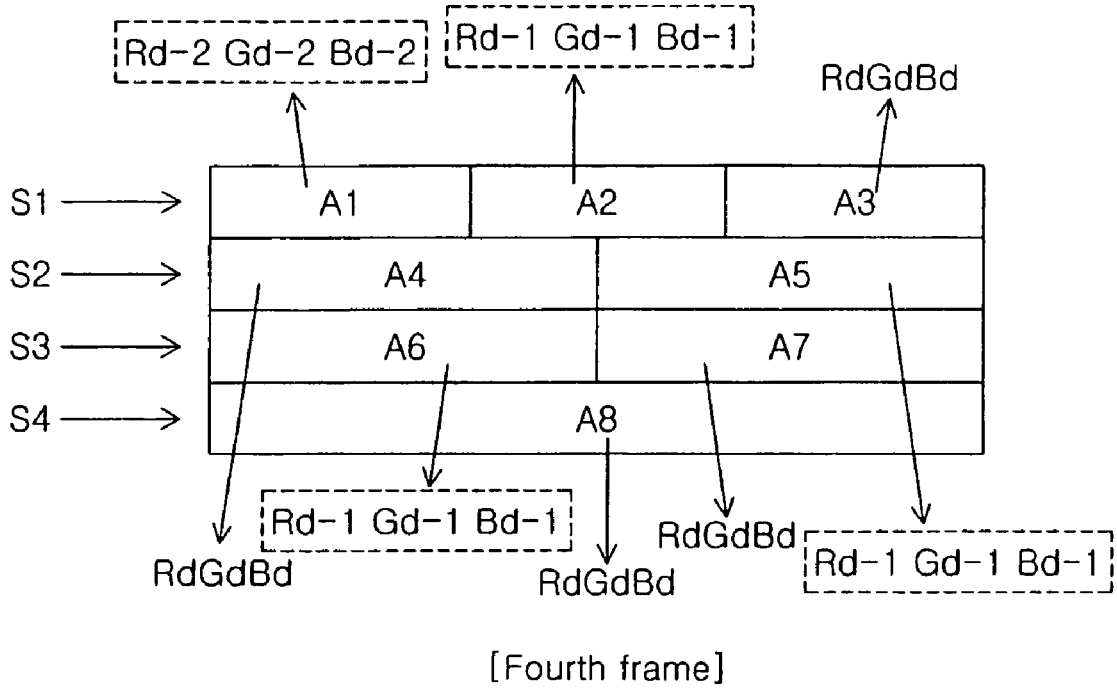
Figure 14F:
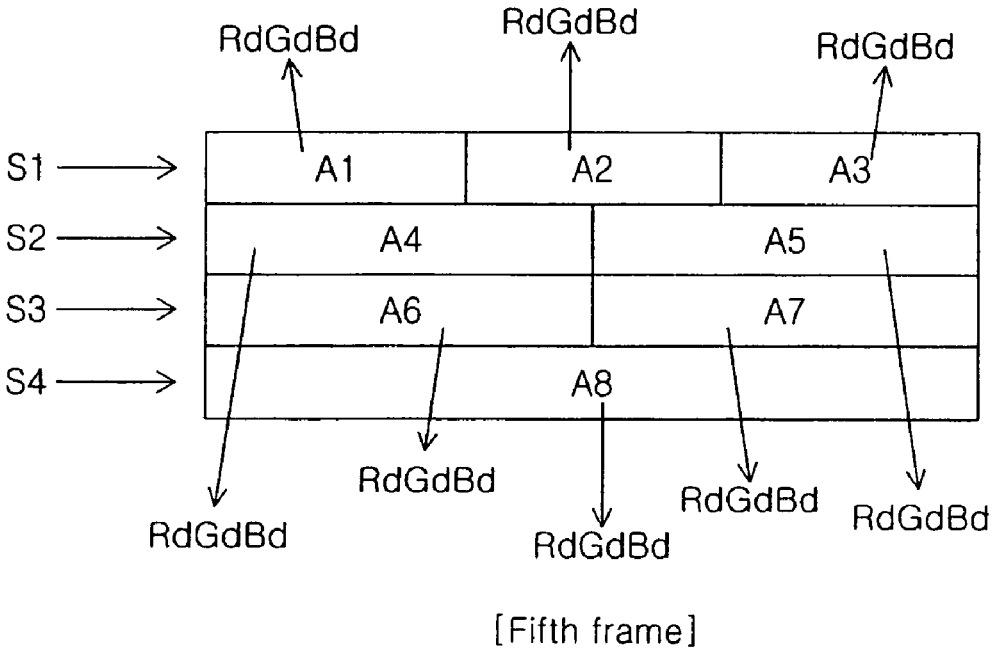
Figure 14G:
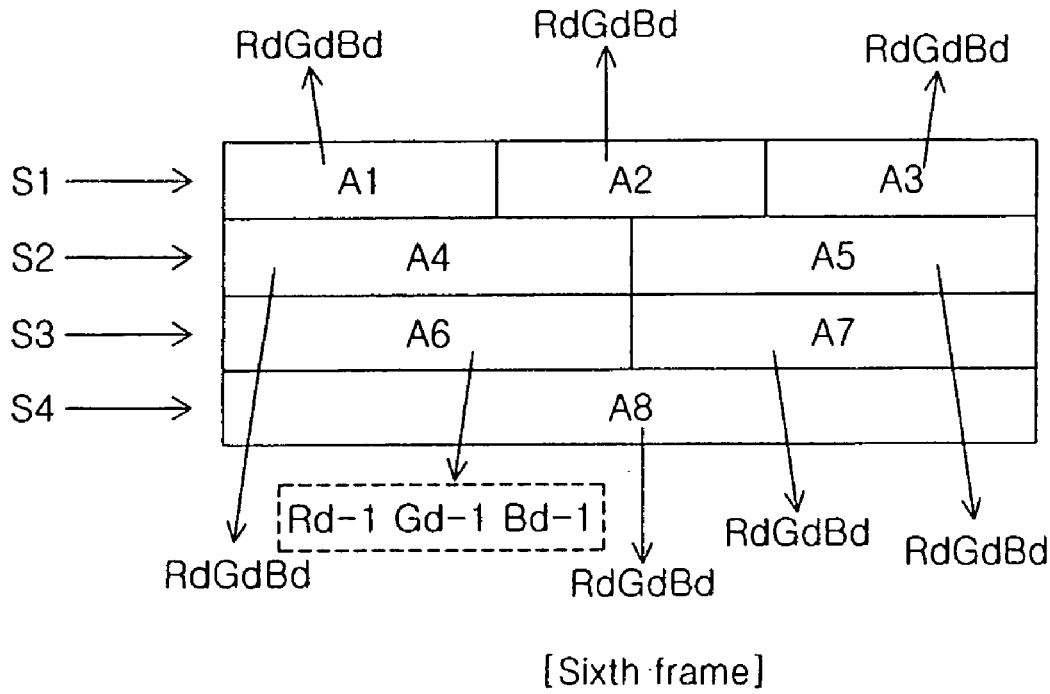
Figure 14H:
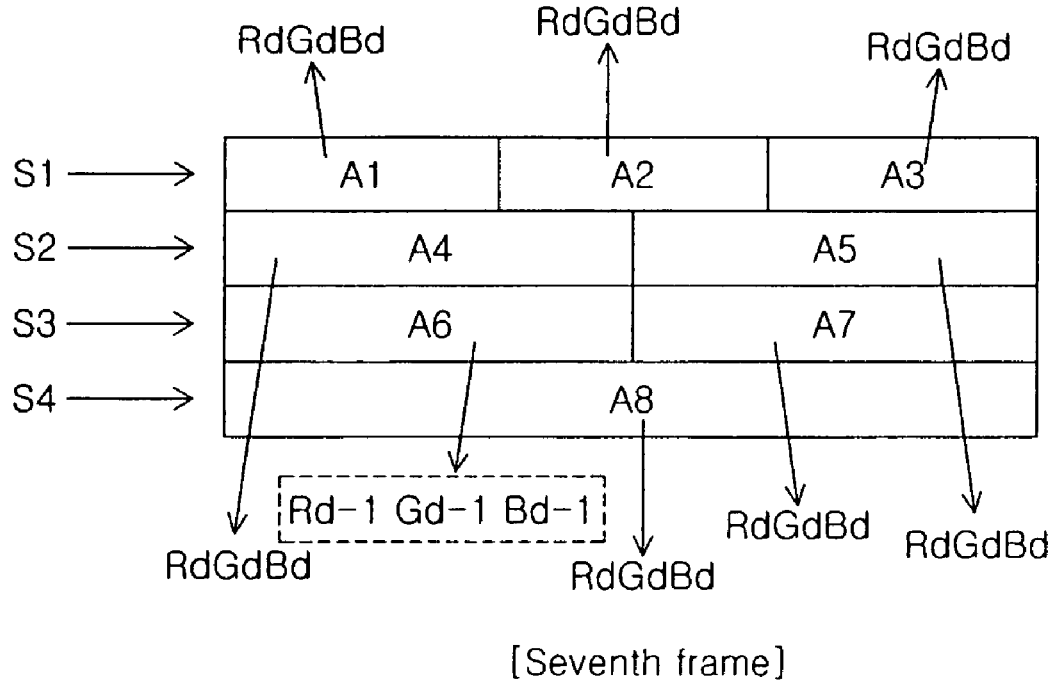
Figure 14I:
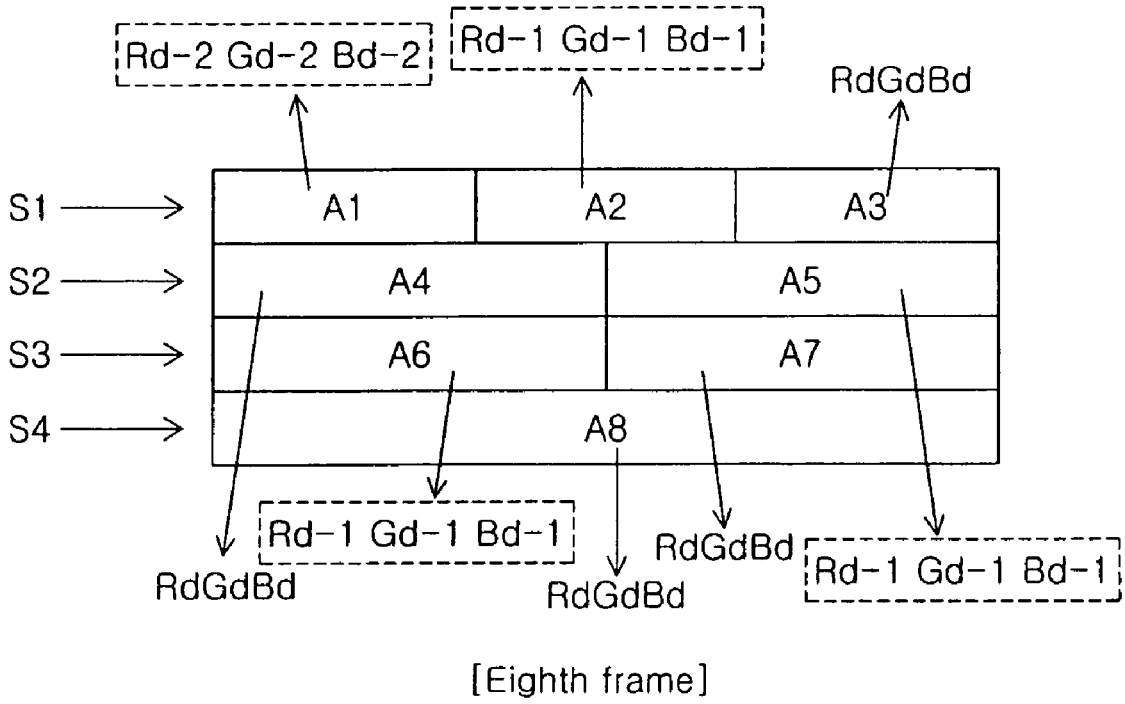

The frame rate and frame level each may be preset to 2 and the brightness of the corresponding area may be lowered by 2 levels during 2 frames of the 8 frames. In particular, the frame circuit 308 may lower the brightness of the first display data RdGdBd by 2 levels during 2 frames (e.g., fourth frame and eighth frame) as shown in FIG. 14E and FIG. 14I. As a result, the brightness of sub-pixels in the sub-area A1 may be lowered by 2 levels as Rd-2Gd-2Bd-2, and the brightness of sub-pixels in the sub-area A2 may be lowered by 1 level as Rd-1Gd-1Bd-1. Accordingly, the sub-areas A1 to A3 corresponding to the first scan line S1 may have the same brightness.

Variables related to the second scan line S2 will now be described.

The frame circuit 308 may determine a pattern as shown in FIG. 14B based on a total amount of current corresponding to the second scan line S2. The area related to the second scan line S2 maw be divided into sub-areas A4 and A5 as shown in FIG. 14B.

Subsequently, the pattern, frame rate and frame level may be set with reference to the total amount of current and resistance corresponding to the second scan line S2 as will be described below.

The second scan line S2 may be disposed to the right of the panel 300, and the resistance corresponding to the sub-area A5 may be smaller than the resistance corresponding to the sub-area A4. Accordingly, when data currents having the same magnitude are provided to the sub-areas A4 and A5, the sub-area A5 may emit a light having a higher brightness than the sub-area A4. Therefore, the pattern may be set to right and the brightness levels may be low on the order of the sub-areas A5 and A4.

The frame rate and frame level may be set to 3 and 1, respectively, and the brightness of the corresponding area may be lowered by 1 level during 3 frames of the 8 frames. More specifically, the frame circuit 308 may lower the brightness of the first display data RdGdBd by 1 level during 3 frames (e.g., second frame, fourth frame and eighth frame) as shown in FIG. 14C, FIG. 14E and FIG. 14I. As a result, the brightness of sub-pixels in the sub-area A5 may be lowered by 1 level to Rd-1Gd-1Bd-1 during the second, fourth and eighth frames. Accordingly, the sub-areas A4 to A5 corresponding to the second scan line S2 may have the same brightness.

The brightness of the sub-areas A1 to A3 related to the first scan line S1 may be compared with the brightness of the sub-areas A4 and A5 related to the second scan line S2.

The brightness of a sub-pixel may be affected by the total amount of current passing through the corresponding scan line and the resistance corresponding to the sub-pixel. When data currents having a same magnitude are provided to sub-pixels related to the scan lines S1 and S2 (e.g. E11 and E12), the sub-pixel E11 may emit a light having a higher brightness than the sub-pixel E12 due to a difference of the resistance corresponding to the sub-pixels E11 and E12. As a result, the first line pattern may occur on the panel.

However, in the display device of an example embodiment of the present invention, since the sub-pixel E11 emits a light having a higher brightness than the sub-pixel E12, the frame circuit 308 may lower the level of the first data current I11 provided to the sub-pixel E11 so that the level of the first data current I11 is smaller than the level of second data current I12 provided to the sub-pixel E12. The display device may lower the level of the first data current I11 corresponding to the sub-pixel E11 during a predetermined number of frames (e.g. 8 frames). As a result, the sub-pixels E11 and E12 may have the same brightness and the first line pattern may not occur between the sub-pixels E11 and E12.

In other words, a brightness difference may not occur between the sub-pixels E11 to Em1 related to the first scan line S1 and the sub-pixels E12 to Em2 corresponding to the second scan line S2.

In the above described method, the frame circuit 308 may set patterns, frame rates and frame levels corresponding to the scan lines S3 and S4 so that the first line pattern does not occur.

Figures 15, 16A:
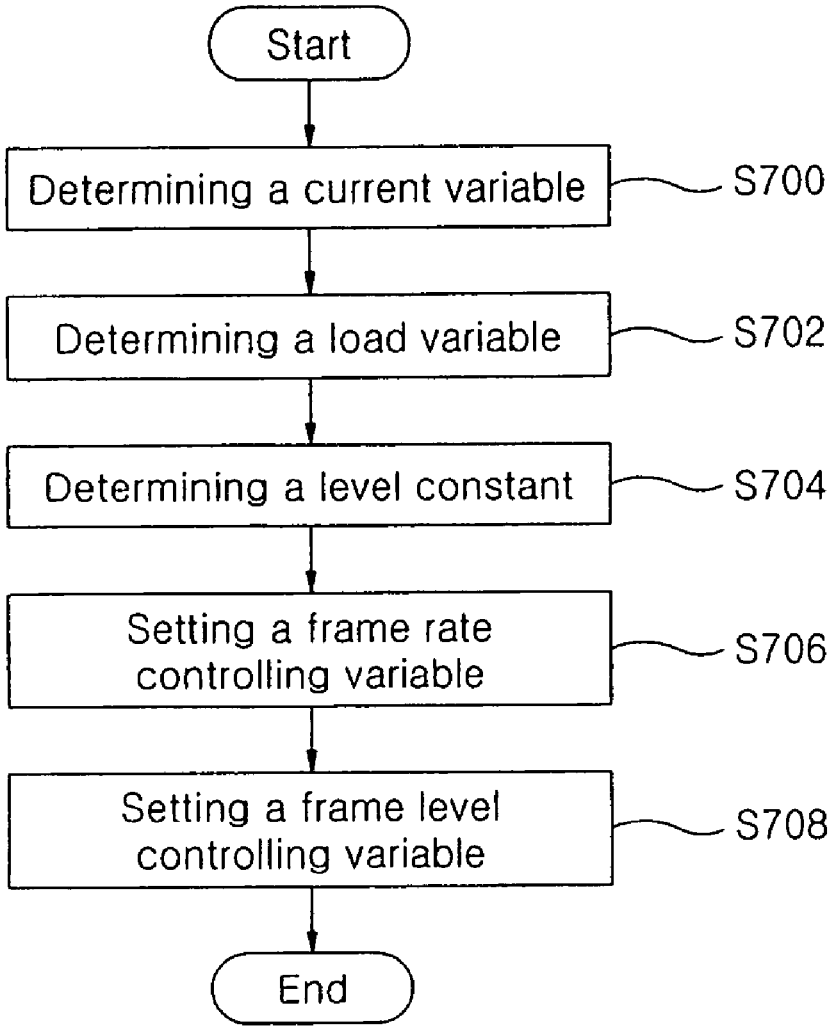
FIG. 15 is a flow chart illustrating a process of setting variables for preventing a cross-talk phenomenon according to an example embodiment of the present invention.
FIGS. 16A-16I are views illustrating a process of preventing a cross-talk phenomenon according to an example embodiment of the present invention.
Figure 16B:
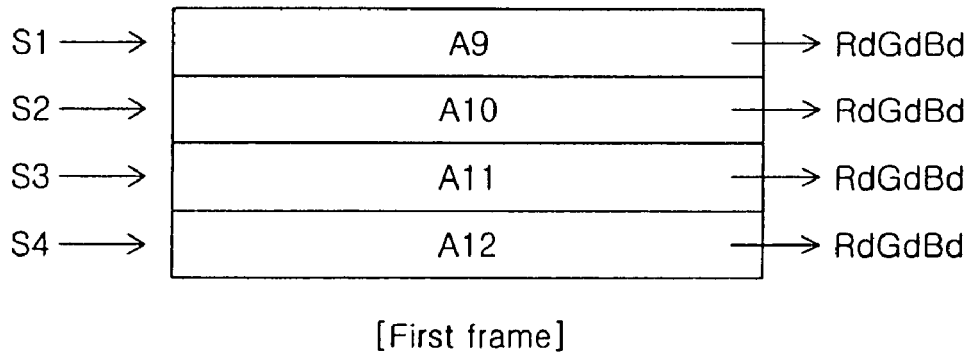
Figure 16C:
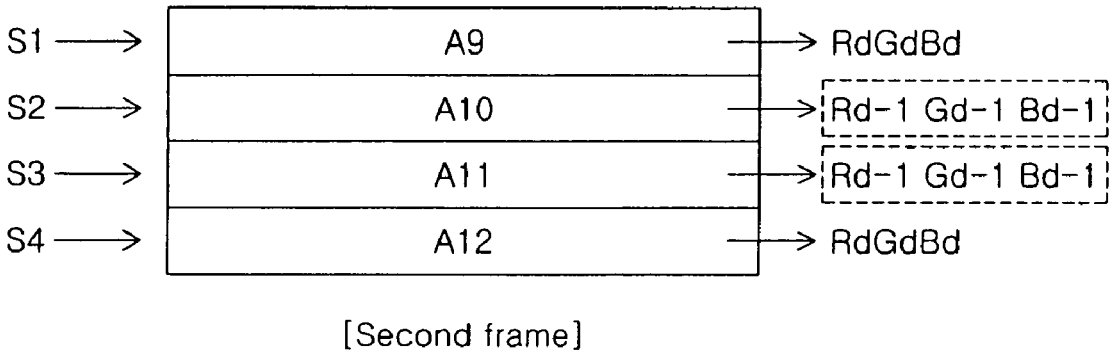
Figure 16D:
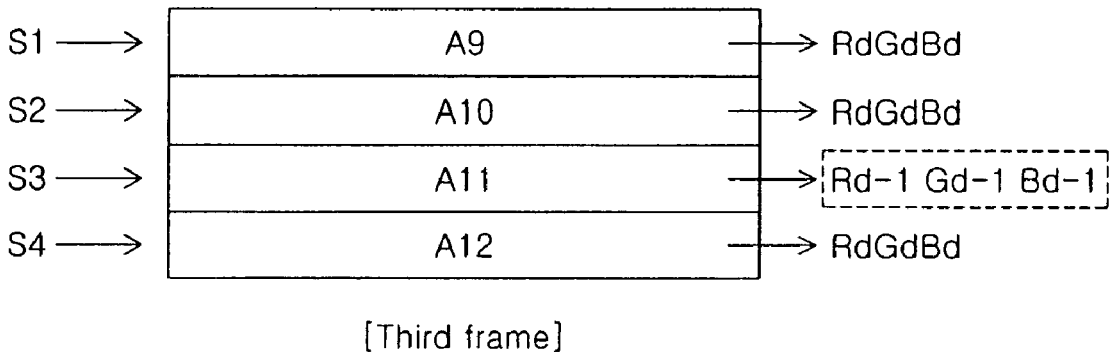
Figure 16E:
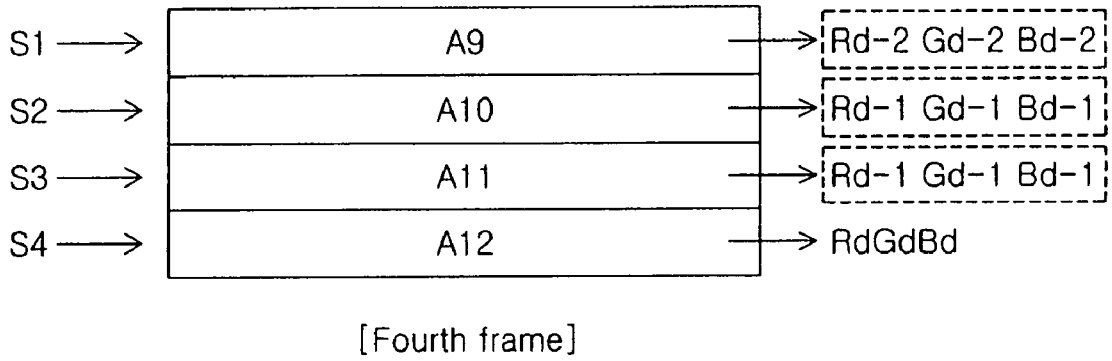
Figure 16F:
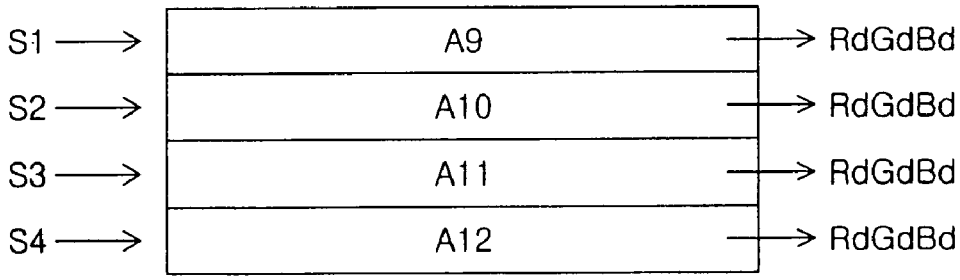
Figure 16G:
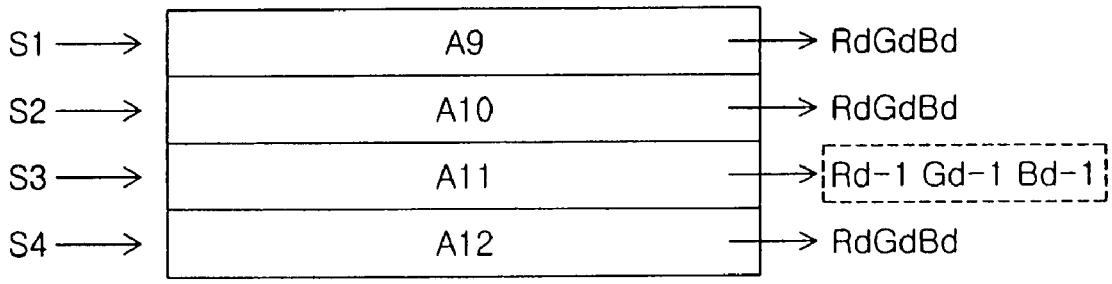
Figure 16H:
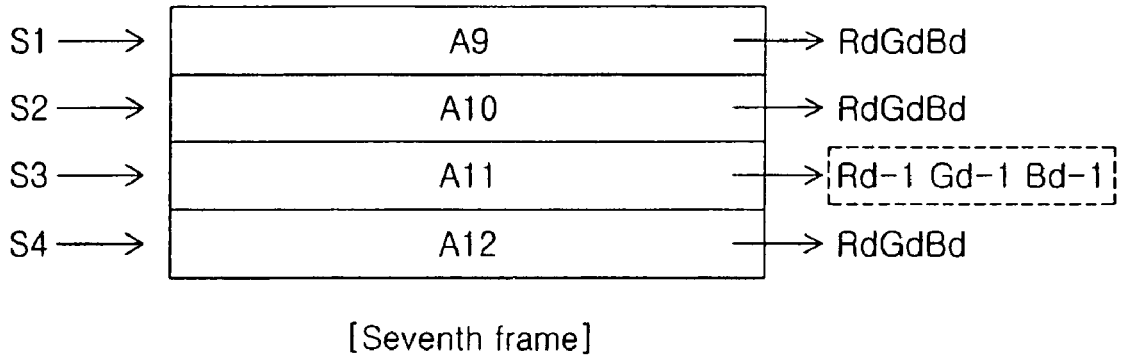
Figure 16I:
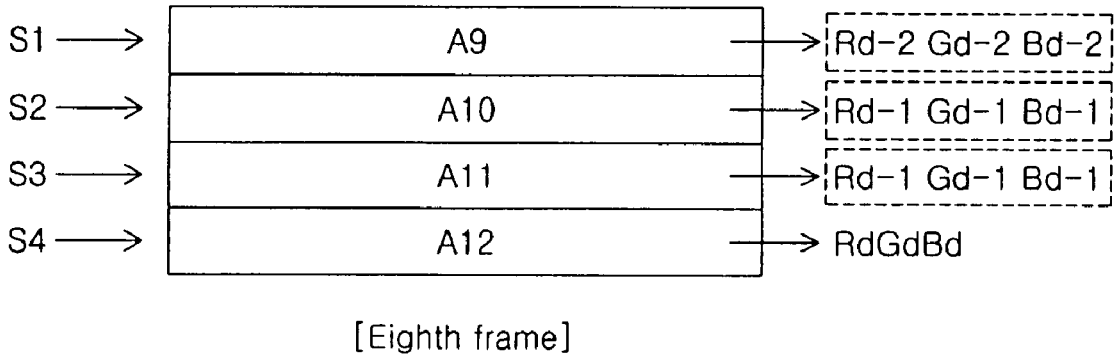

FIG. 15 is a flow chart illustrating a process of setting variables for preventing a cross-talk phenomenon according to an example embodiment of the present invention. Other embodiments, configurations, operations and orders of operation are also within the scope of the present invention.

In operation S700, the display device may add currents passing through each of the scan lines S1 to S4 for a predetermined number of frames (e.g. 8 frames) to calculate the total amount of current corresponding to each of the scan lines S1 to S4. The display device may then determine a current variable based on the total amount of current.

In operation S702, the frame circuit 308 may determine a load variable through the first display data. In operation S704, the frame circuit 308 may determine a level constant to be adjusted during the 8 frames.

In operation S706, the frame circuit 308 may set a frame rate controlling variable based on the level constant and then set a frame level controlling variable in operation S708.

The process of setting variables in FIG. 15 and the process of preventing a cross-talk phenomenon will now be described with reference to FIG. 12A, FIG. 12C and FIGS. 16A-16I.

FIGS. 16A-16I are views illustrating a process of preventing the cross-talk phenomenon according to an example embodiment of the present invention. Other embodiments and configurations are also within the scope of the present invention. In this example, data currents corresponding to display data of the first display data related to the third scan line S3 have 0 A and the other data currents have 3 A. Further, in this example each of data currents corresponding to the first display data related to the first scan line S1 has 3 A. The assumed first display data are repeatedly inputted to the controller 302 during the 8 frames.

The frame circuit 308 may compare the total amount of current corresponding to the first scan line S1 with the total amount of current corresponding to the third scan line S3 through the display data transmitted from the controller 302. The frame circuit 308 may confirm that the total amount of current corresponding to the first scan line S1 is higher than the total amount of current corresponding to the third scan line S3 based on the compared result.

Subsequently, in accordance with the confirmed result, the frame circuit 308 may lower the brightness of the sub-pixels E11 to Em1 related to the first scan line S1 to lower than the brightness of the sub-pixels E13 to Em3 related to the third scan line. This is because the sub-pixel related to the third scan line S3 (e.g. E13) emits a light having a higher brightness than the sub-pixel (e.g. E11) related to the first scan line S1. For example, the frame circuit 308 may lower the brightness of the sub-pixels E11 to Em1 related to the first scan line S1 by 4 levels during the 8 frames as shown in FIG. 16A. The frame circuit 308 may lower the brightness of the sub-pixels E13 to Em3 related to the third scan line S3 by 6 levels during the 8 frames.

In an example embodiment of the present invention, the frame circuit 308 may lower the brightness of the sub-pixels E11 to Em1 related to the first scan line S1 by 2 levels during each of the fourth and eighth frames of the 8 frames as shown in FIGS. 16A-16I. The frame circuit 308 may also lover the brightness of the sub-pixels E13 to Em3 related to the third scan line S3 by 1 level during each of 6 frames (second to fourth frames, sixth to eighth frames) of the 8 frames as shown in FIGS. 16A-16I.

As described above, the display device may adjust the brightness level of sub-pixels related to scan lines so that the sub-pixels have a same brightness irrespective of the total amount of current and so the cross-talk phenomenon does not occur (or substantially does not occur) to the panel 300.

In the above process, the first scan line S1 and the third scan line S3 may be disposed in a same direction and the resistance corresponding to the sub-pixels E11 to Em1 related to the first scan line S1 may be substantially identical to the resistance corresponding to the sub-pixels E13 to Em3 related to the third scan line S3. However, scan lines (e.g. first and second scan lines) may be disposed in different directions and the resistances corresponding to the scan lines may be different. In this case, the display device may set the frame rate and frame level based on the differences of resistance. Accordingly, the cross-talk phenomenon may not occur to the panel 300.

The display device may convert first display data into second display data based on both the total amount of current and the corresponding resistance that affects brightness of sub-pixels and so the first line pattern and cross-talk phenomenon do not occur to the panel 300.

Figure 17:
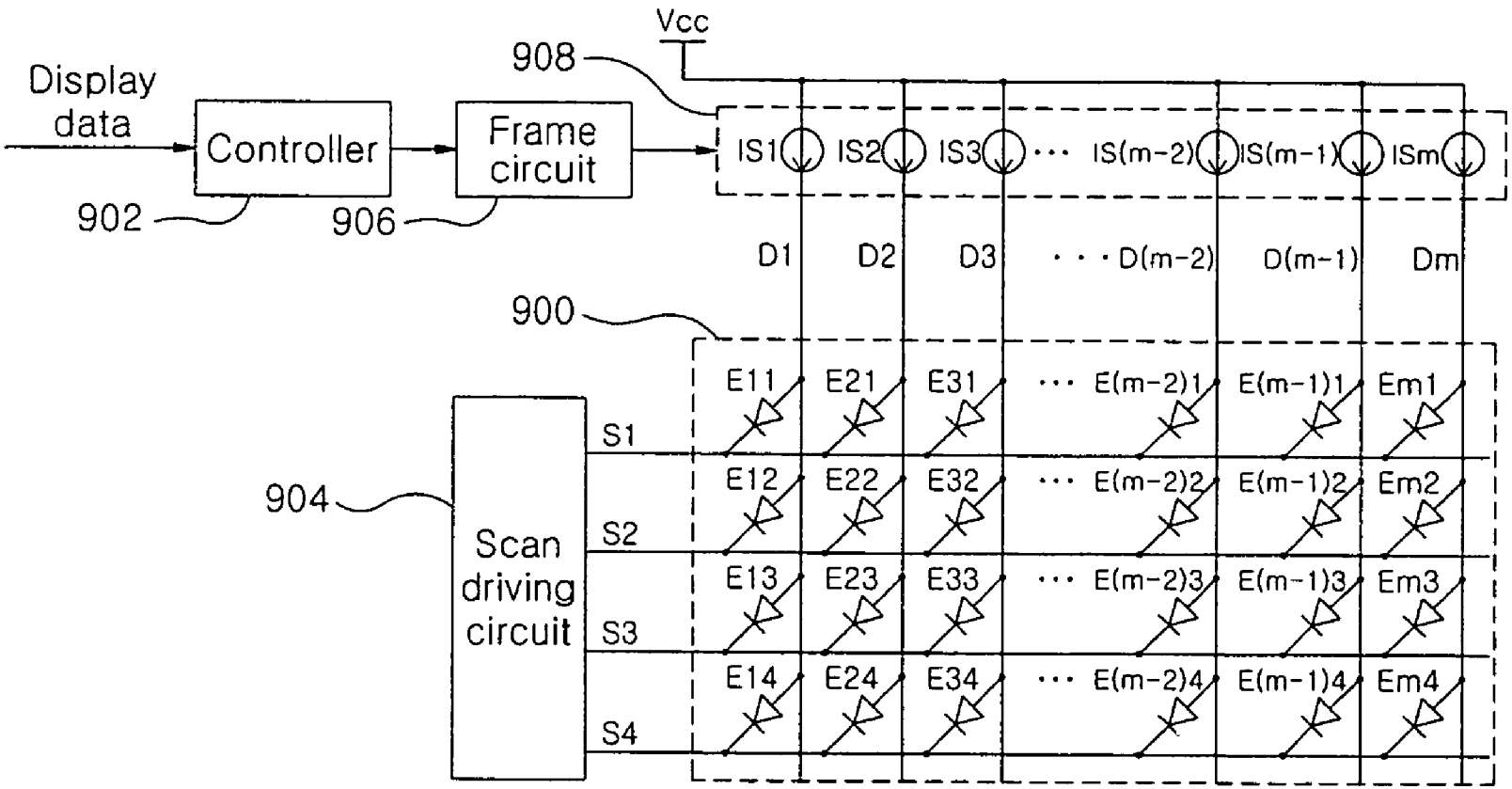
FIG. 17 is a view illustrating a display device according to an example embodiment of the present invention.

FIG. 17 is a view illustrating a display device according to an example embodiment of the present invention. Other embodiments and configuration are also within the scope of the present invention.

As shown in FIG. 17, the display device include a panel 900, a controller 902, a scan driving circuit 904, a frame circuit 906 and a data driving circuit 908.

Since elements of this embodiment (except the scan driving circuit 904) are similar to elements described above, a further description concerning the same elements will be omitted for ease of illustration.

In at least one embodiment, the scan driving circuit 904 may transmit scan signals to the scan lines S1 to S4 in one direction of the panel 900.

In the above described embodiments, the display device may lower the brightness level of the first display data to prevent (or reduce) the first line pattern and the cross-talk phenomenon. However, in another embodiment, the display device may increase the brightness level of the first display data so as to prevent (or reduce) the first line pattern and the cross-talk phenomenon.

Figures 18, 19A:
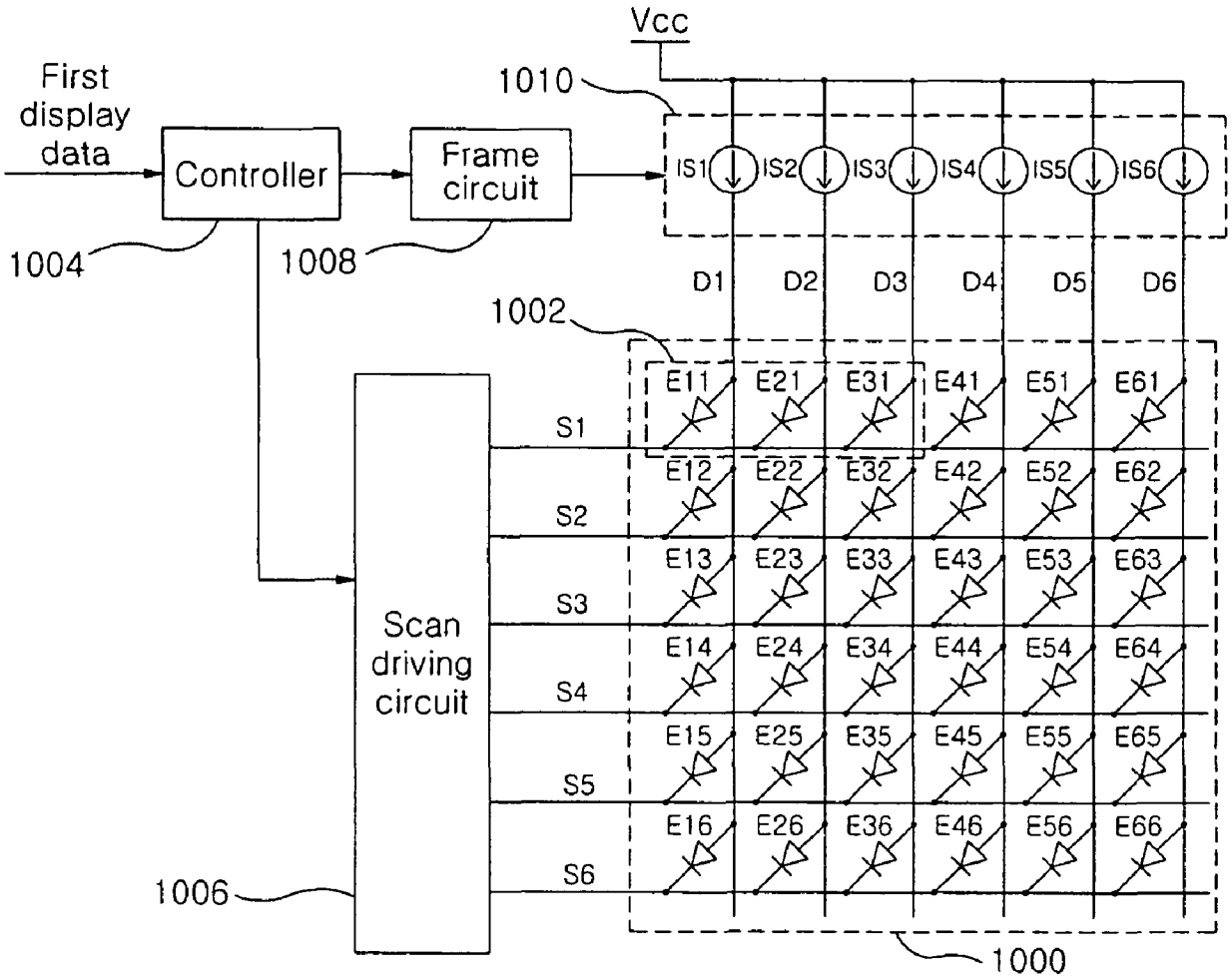
FIG. 18 is a view illustrating a display device according to an example embodiment of the present invention.
FIGS. 19A-19E are views illustrating a process of controlling a brightness according to an example embodiment of the present invention.
Figure 19B:
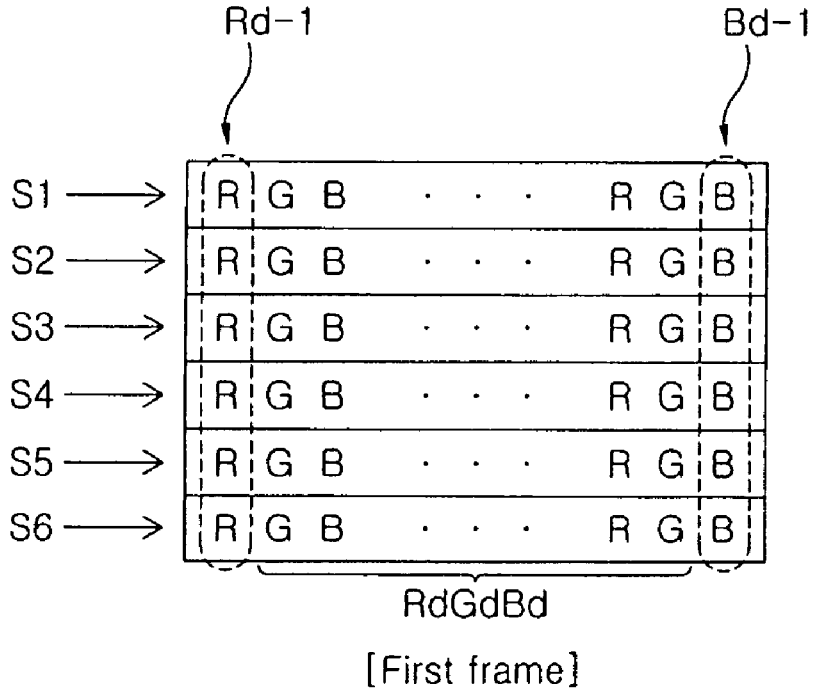
Figure 19C:
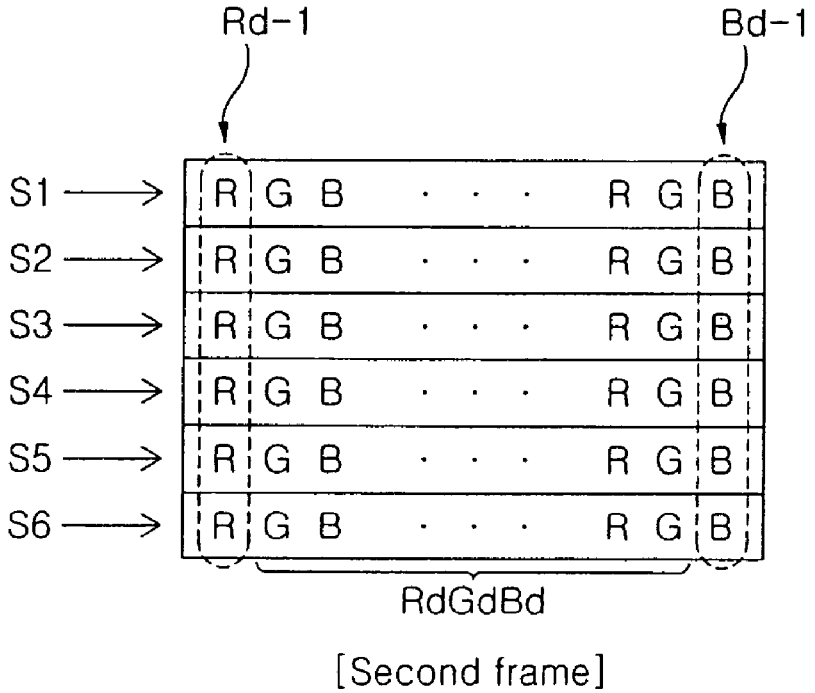
Figure 19D:
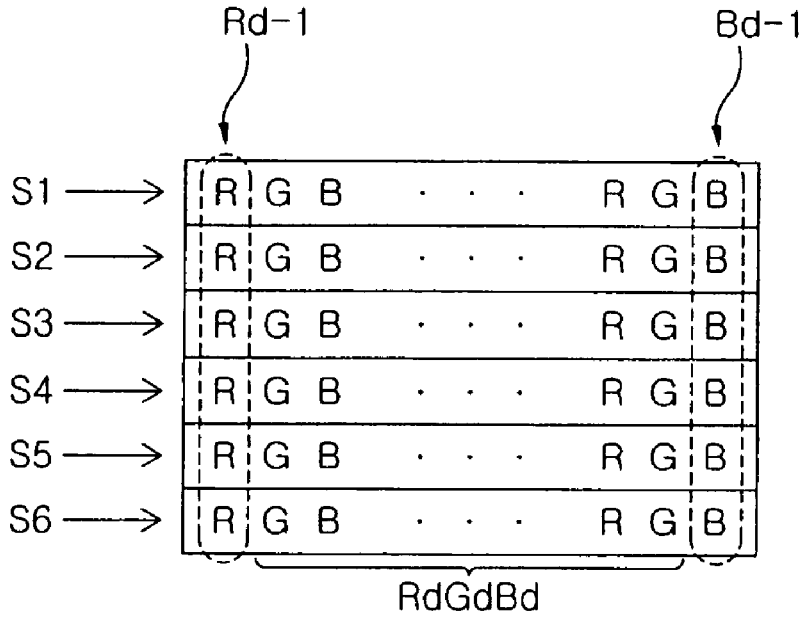
Figure 19E:
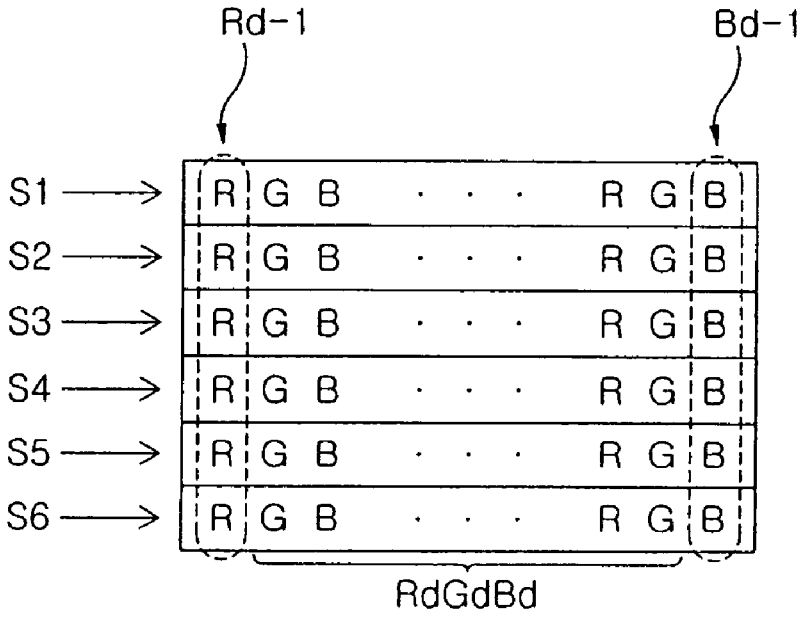

FIG. 18 is a view illustrating a display device according to an example embodiment of the present invention. Other embodiments and configurations are also within the scope of the present invention. Hereafter, the size of panel 1000 will be described as 6×6.

In FIG. 18, the display device may include a panel 1000 and a driver. The driver may include a controller 1004, a scan driving circuit 1006, a frame circuit 1008 and a data driving circuit 1010.

The panel 1000 may have a plurality of sub-pixels E11 to E66 formed in cross areas of data lines D1 to D6 and scan lines S1 to S6. A pixel 1002 may be composed of one red sub-pixel, one green sub-pixel and one blue sub-pixel.

The controller 1004 may receive first display data (e.g. RGB data) from an apparatus (not shown) located outside of the display device and control the scan driving circuit 1006, the frame circuit 1008 and the data driving circuit 1010 based on the received first display data. In addition, the controller 1004 may store the first display data and transmit the first display data to the frame circuit 1008.

The scan driving circuit 1006 may transmit scan signals to the scan lines S1 to S6 under control of the controller 1004. As a result, the scan lines S1 to S6 may be coupled in sequence to ground.

The frame circuit 1008 may convert the first display data transmitted from the controller 1004 into second display data. The frame circuit 1008 may convert the first display data into the second display data having a lower brightness than the first display data.

The data driving circuit 1010 may include a plurality of current sources IS1 to IS6 and the data driving circuit 1010 may provide data currents synchronized with the scan signals and corresponding to the second display data to the data lines D1 to D6. As a result, the sub-pixels related to the scan line coupled to ground may emit light.

The process of driving the sub-pixels E11 to E16 will now be described.

A first scan line S1 may be coupled to ground and the other scan lines S2 to S6 may be coupled to a voltage source having a same magnitude as a driving source (Vcc) of the display device. Accordingly, data currents outputted from the current sources IS1 to IS6 may be provided to ground through the data lines D1 to D6, the sub-pixels E11 to E61 and the first scan line S1. Thus, the sub-pixels E11 to E61 related to the first scan line S1 may emit light.

Subsequently, a second scan line S2 may be coupled to ground and the other scan lines S1, S3 to S6 may be coupled to the voltage source. As a result, the sub-pixels E12 to E62 corresponding to the second scan line S2 may emit light.

Sub-pixels E13 to E66 corresponding to the scan lines S3 to S6 may emit light through a similar type of method. Subsequently, the above process of emitting light in the pixels E11 to E66 may be repeated for a unit of frame (i.e., scan lines S1 to S6).

In this emitting process, the display device may lower the brightness of sub-pixels E11 to E16, E61 to E66 corresponding to the outermost data lines D1 and D6 of the data lines D1 to D6 by a certain level for a unit of N (integer of 2 or more) frames for the lowered brightness to be lower than a predetermined brightness. The predetermined brightness may correspond to a brightness corresponding to the first display data inputted to the controller 1004 and related to the outermost data lines D1 and D6.

A process of adjusting brightness by the frame circuit 1008 will now be described in detail. More specifically, FIGS. 19A-19I are views illustrating a process of controlling a brightness according to an example embodiment of the present invention. FIGS. 20A-20E are views illustrating a process of controlling brightness according to an example embodiment of the present invention. FIGS. 21A-21I are views illustrating a process of controlling brightness according to an example embodiment of the present invention. Other embodiments and configurations are also within the scope of the present invention.

In FIG. 19A, the frame circuit 1008 may set a frame number (N) and adjust a variable brightness level of the sub-pixels E11 to E16, E61 to E66 related to the outermost data lines D1 and D6 based on analysis of first display data corresponding to N frames. The brightness adjusting level variable may indicate a magnitude of brightness level of the sub-pixels E11 to E16 and E61 to E66 to be adjusted during the N frames.

For example, the frame circuit 1008 may set both the frame number and the frame brightness level to 4. Accordingly, the frame circuit 1008 may set the frame rate and frame level to 4 and 1, respectively, and the brightness of corresponding sub-pixels may be lowered by 1 level during each of the 4 frames. As a result, the frame circuit 1008 may lower the brightness of the sub-pixels E11 to E16 and E61 to E66 by 1 level during each of the 4 frames as shown in FIGS. 19B-19E. That is, the frame circuit 1008 may lower the brightness of data Rd and Bd related to the outmost data lines D1 and D6 of the first display data by 1 level, and generate second display data having data Rd-1 and Bd-1 related to the outermost data lines D1 and D6.

Accordingly, data currents having a lower brightness than the predetermined brightness (i.e., the brightness corresponding to the first display data) may be provided to the outermost data lines D1 and D6. As a result, a second line pattern (e.g. red line pattern and blue line pattern) may not occur to the outermost data lines D1 and D6 of the panel 1000.

Figures 20A, 20B:
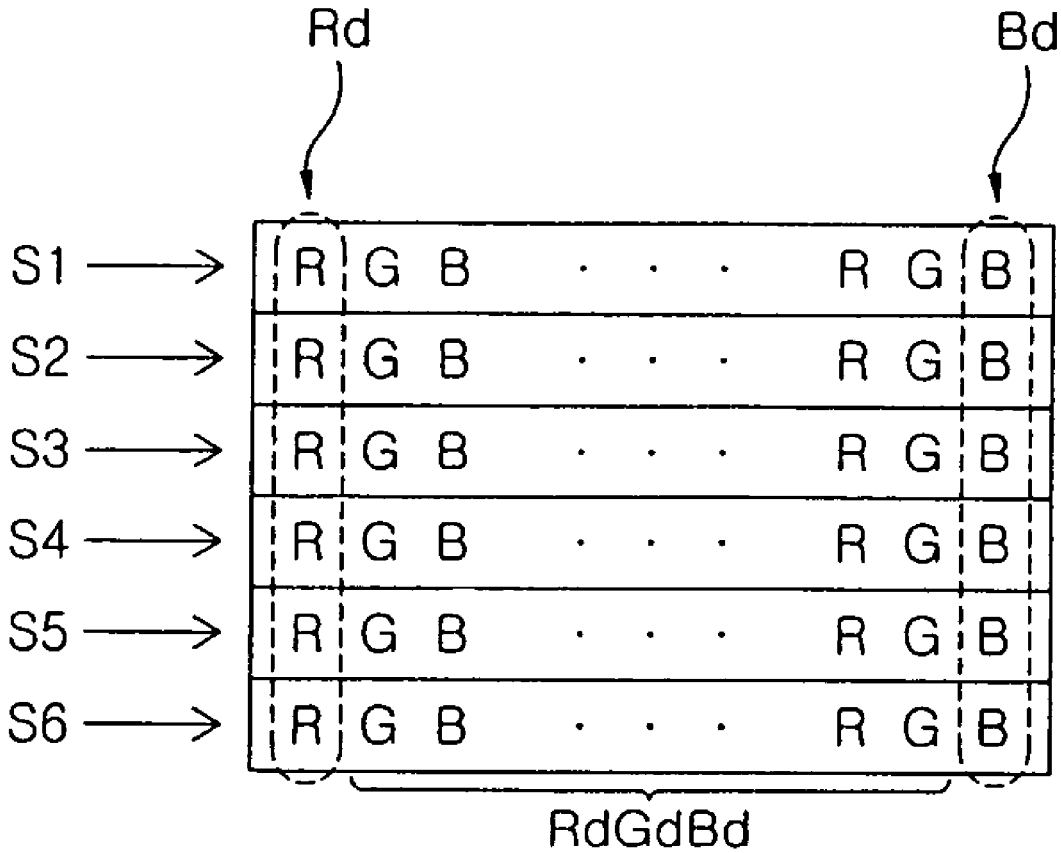
FIGS. 20A-20E are views illustrating a process of controlling a brightness according to an example embodiment of the present invention.
Figure 20C:
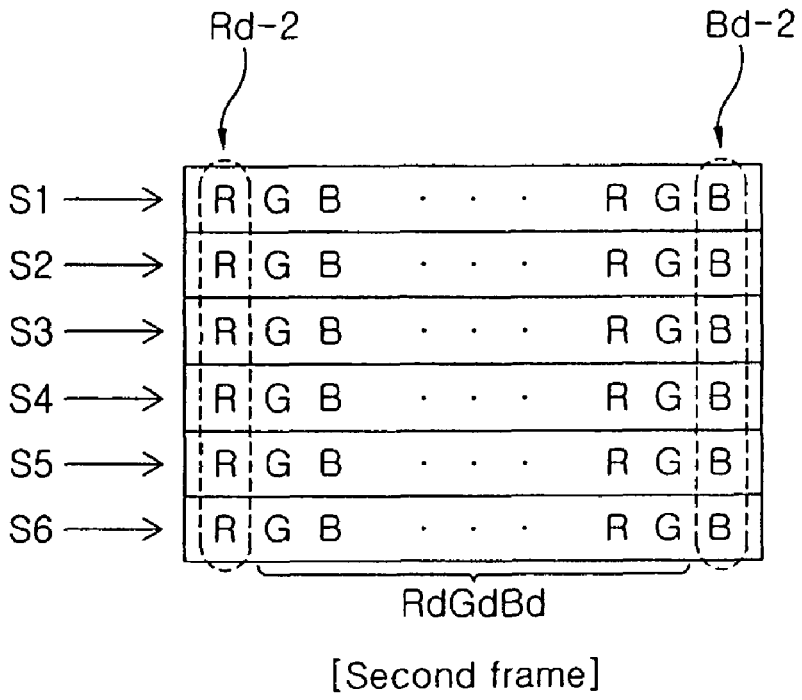
Figure 20D:
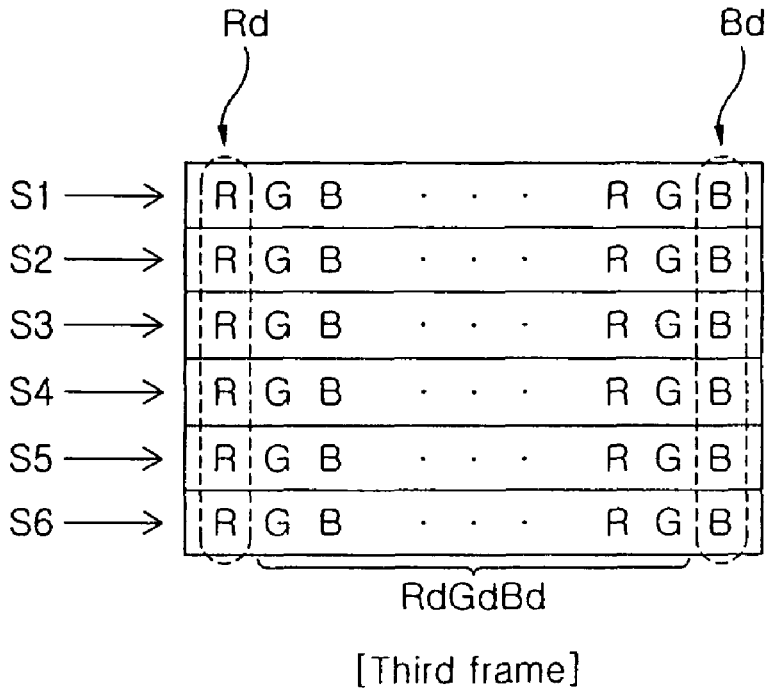
Figures 20E, 21A:
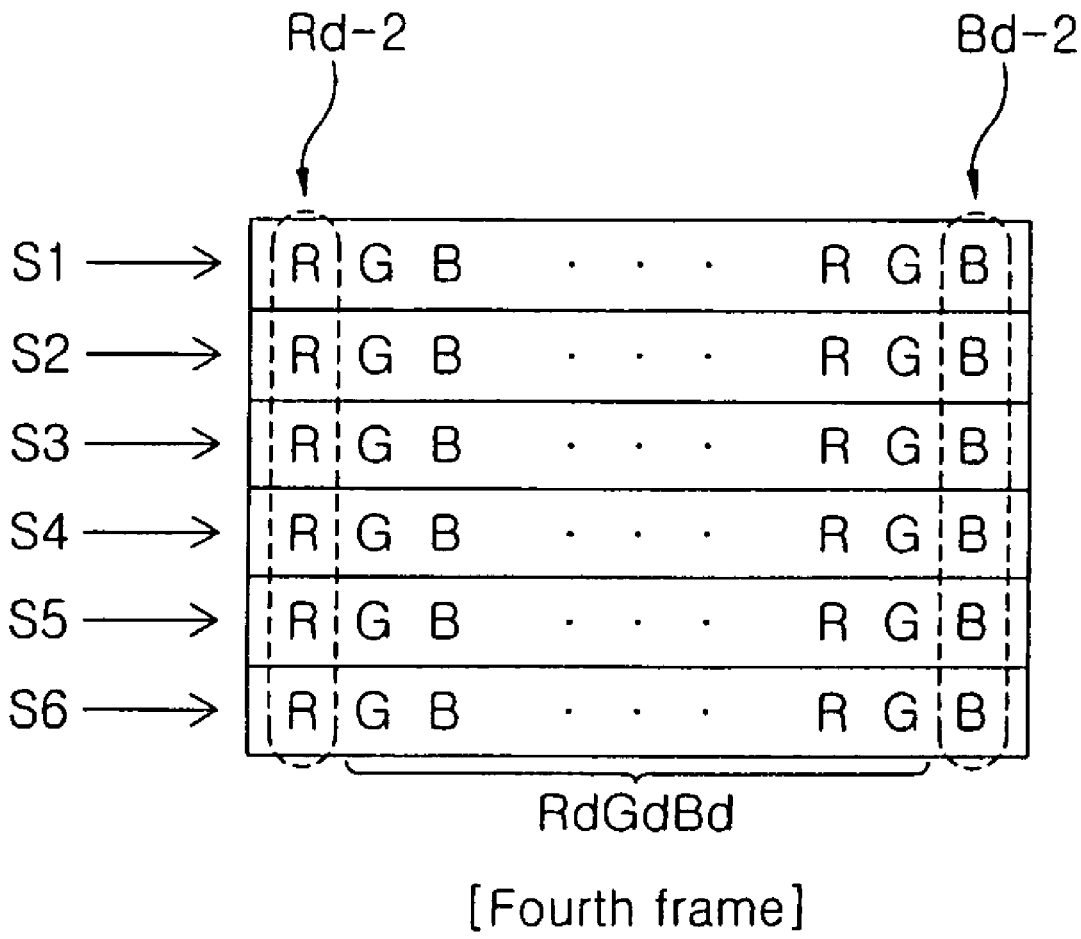
FIGS. 21A-21I are views illustrating a process of controlling a brightness according to an example embodiment of the present invention.
Figure 21B:
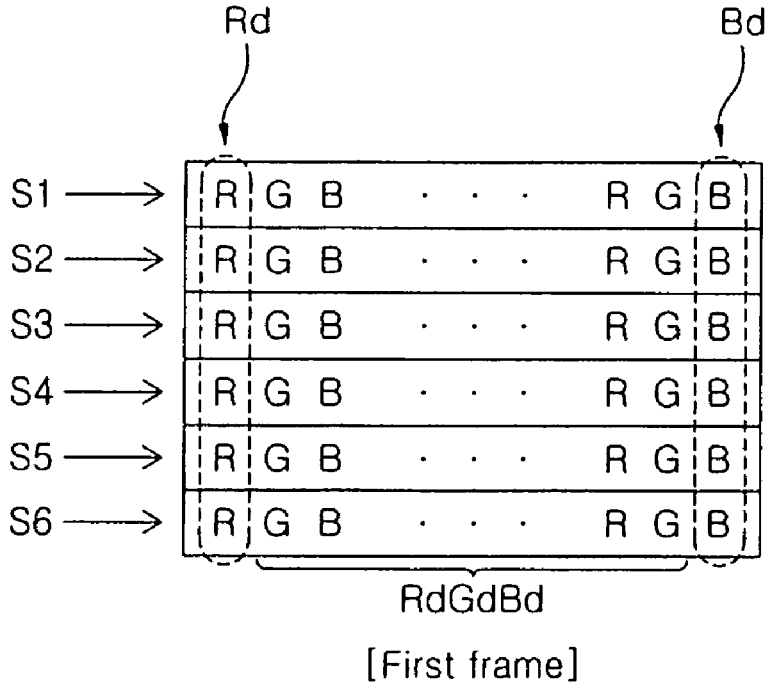
Figure 21C:
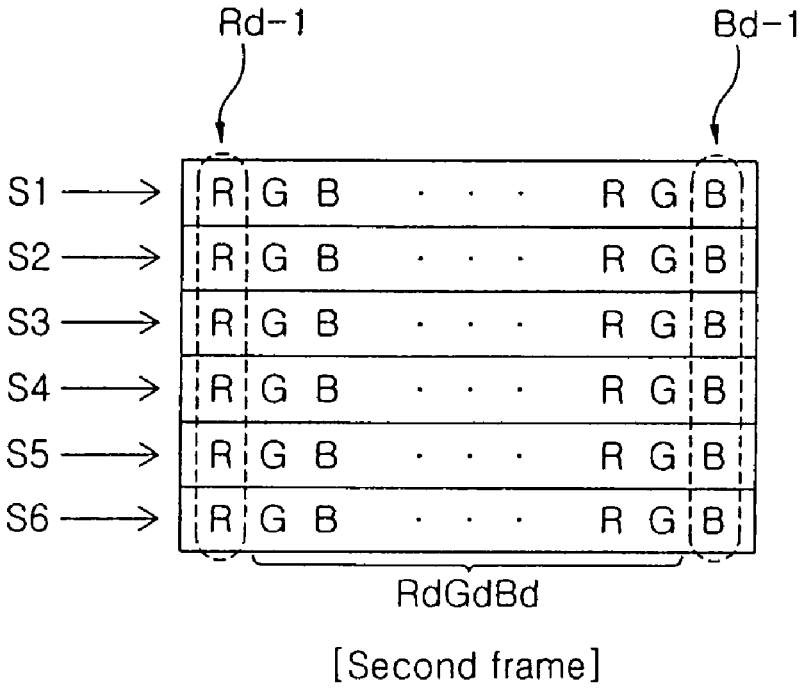
Figure 21D:
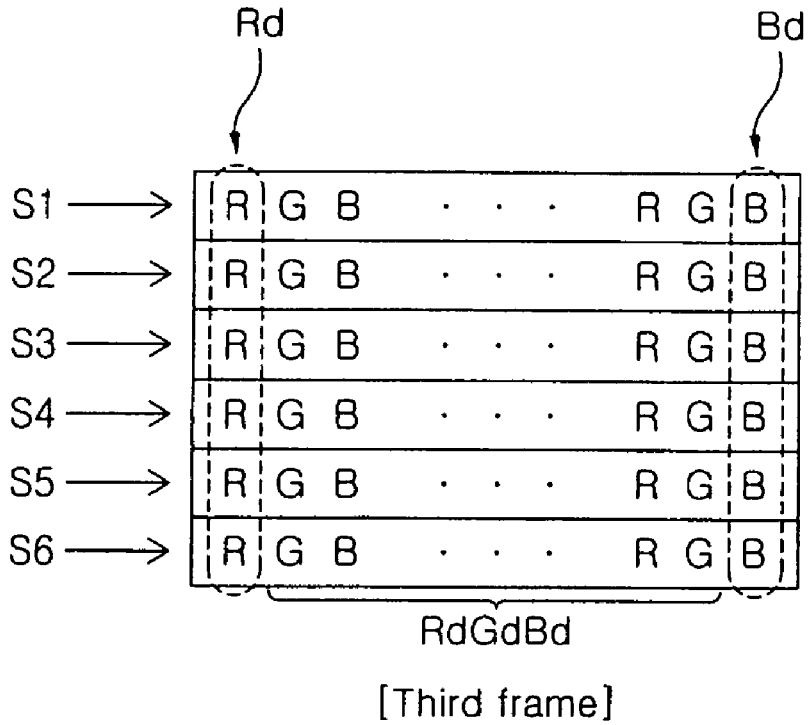
Figure 21E:
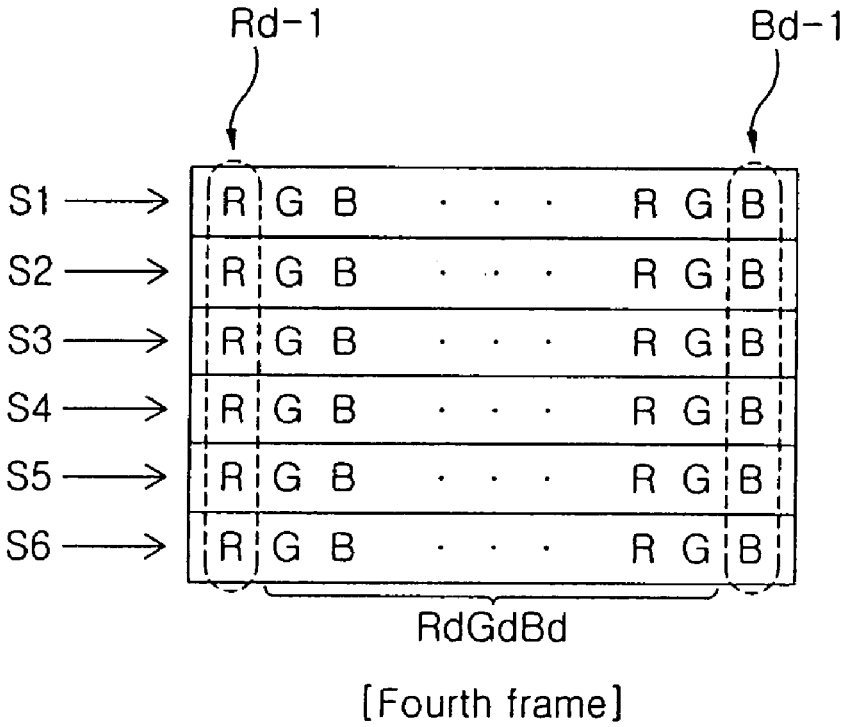
Figure 21F:
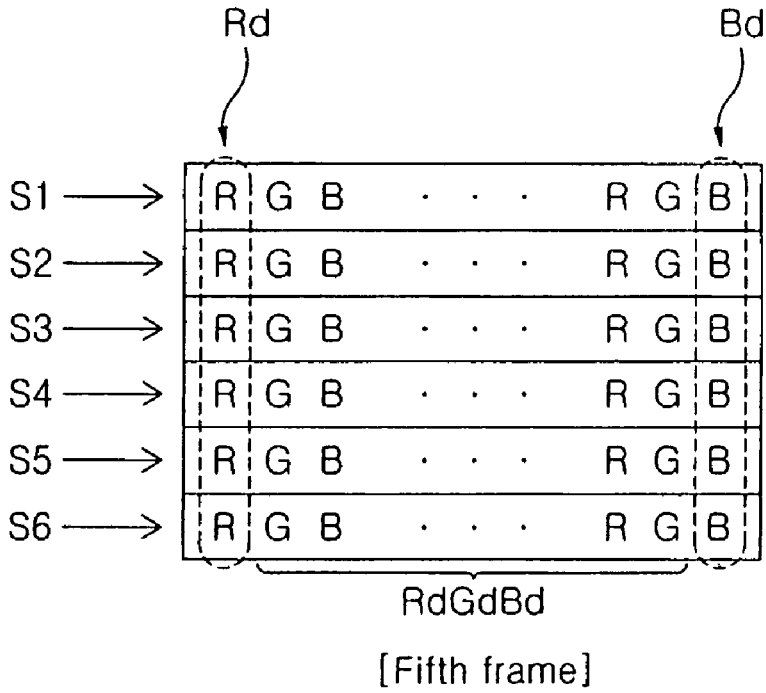
Figure 21G:
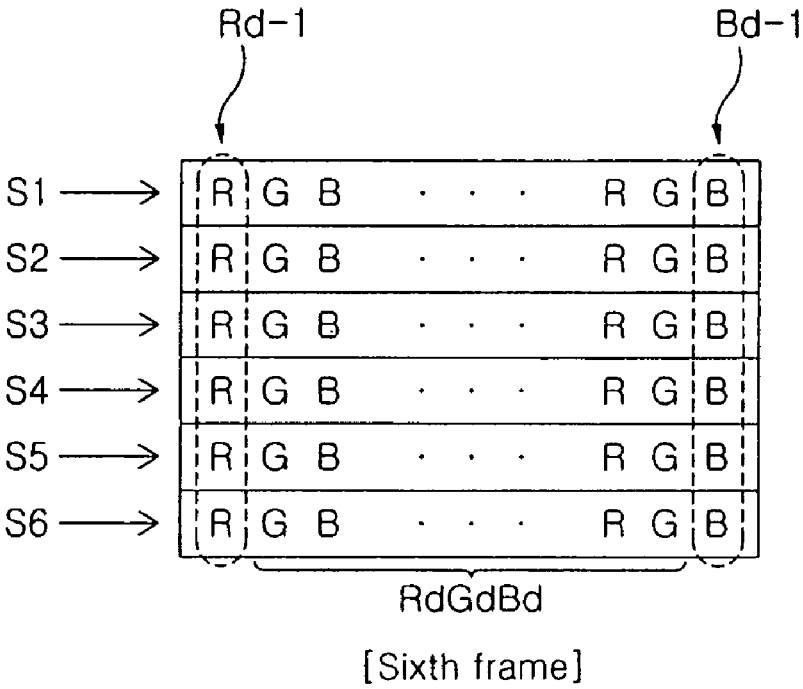
Figure 21H:
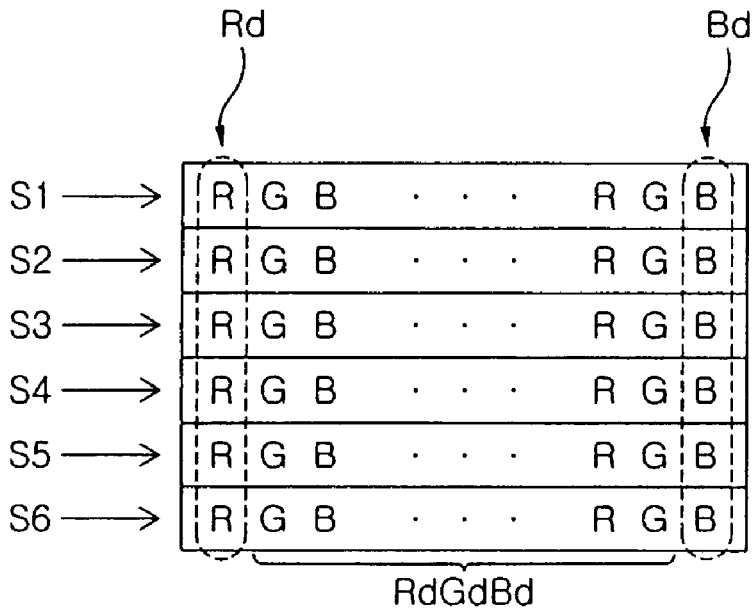
Figure 21I:
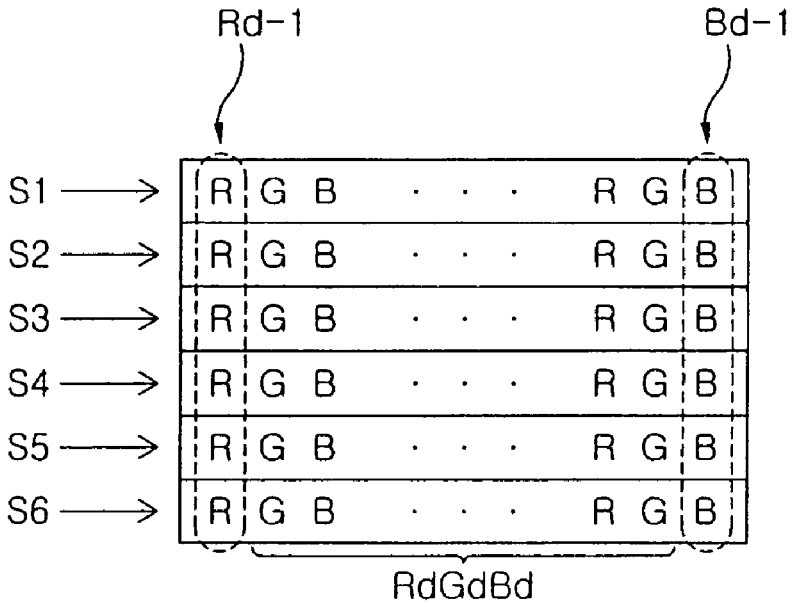

In another example, as shown in FIG. 20A, the frame circuit 1008 may set the frame number, frame rate and frame level to 4, 2 and 2, respectively, and the brightness of corresponding sub-pixels may be lowered by 2 levels during each of 2 frames of the 4 frames. As a result, the frame circuit 1008 may lower the brightness of the sub-pixels E11 to E16 and E61 to E66 by 2 levels during each of 2 frames of the 4 frames (e.g., second frame and fourth frame) as shown in FIGS. 20C-20E. In other words, the frame circuit 1008 may lower the brightness of data Rd and Bd related to the outermost data lines D1 and D6 of the first display data by 2 levels, and generate second display data having data Rd-2 and Bd-2 related to the outermost data lines D1 and D6 during the second and fourth frames.

The display device may set the frame number, the frame rate, and the frame level by analyzing N first display data, and lower the brightness of the sub-pixels E11 to E16, E61 to E66 related to the outermost data lines D1 and D6 in a unit of N frames based on the set result. The display device may set the frame rate and frame level differently to a same frame number and a same brightness adjusting level variable as shown in the above examples.

In still another example, as shown in FIG. 21A, the frame circuit 1008 may set the frame number, the frame rate and the frame level to 8, 4 and 1, respectively, and the brightness of the corresponding sub-pixels may be lowered by 1 level during each of 4 frames of the 8 frames. As a result, the frame circuit 1008 may lower the brightness of the sub-pixels E11 to E16 and E61 to E66 by 1 level during each of 4 frames of the 8 frames (e.g. second, fourth, sixth and eighth frames) as shown in FIG. 21C, FIG. 21E, FIG. 21G and FIG. 21I. In other words, the frame circuit 1008 may lower the brightness of data Rd and Bd related to the outermost data lines D1 and D6 of the first display data by 1 level, and generate second display data having data Rd-1 and Bd-1 related to the outermost data lines D1 and D6 during the second, fourth, sixth and eighth frames.

The display device may lower the brightness of the first display data by a certain level for a unit of frames so that the second line pattern does not occur to the panel 1000.

In an example embodiment of the present invention, a pixel may be made of one red sub-pixel, one green sub-pixel, one blue sub-pixel and one white sub-pixel. The constitution of the pixel may also be varied.

Figure 22:
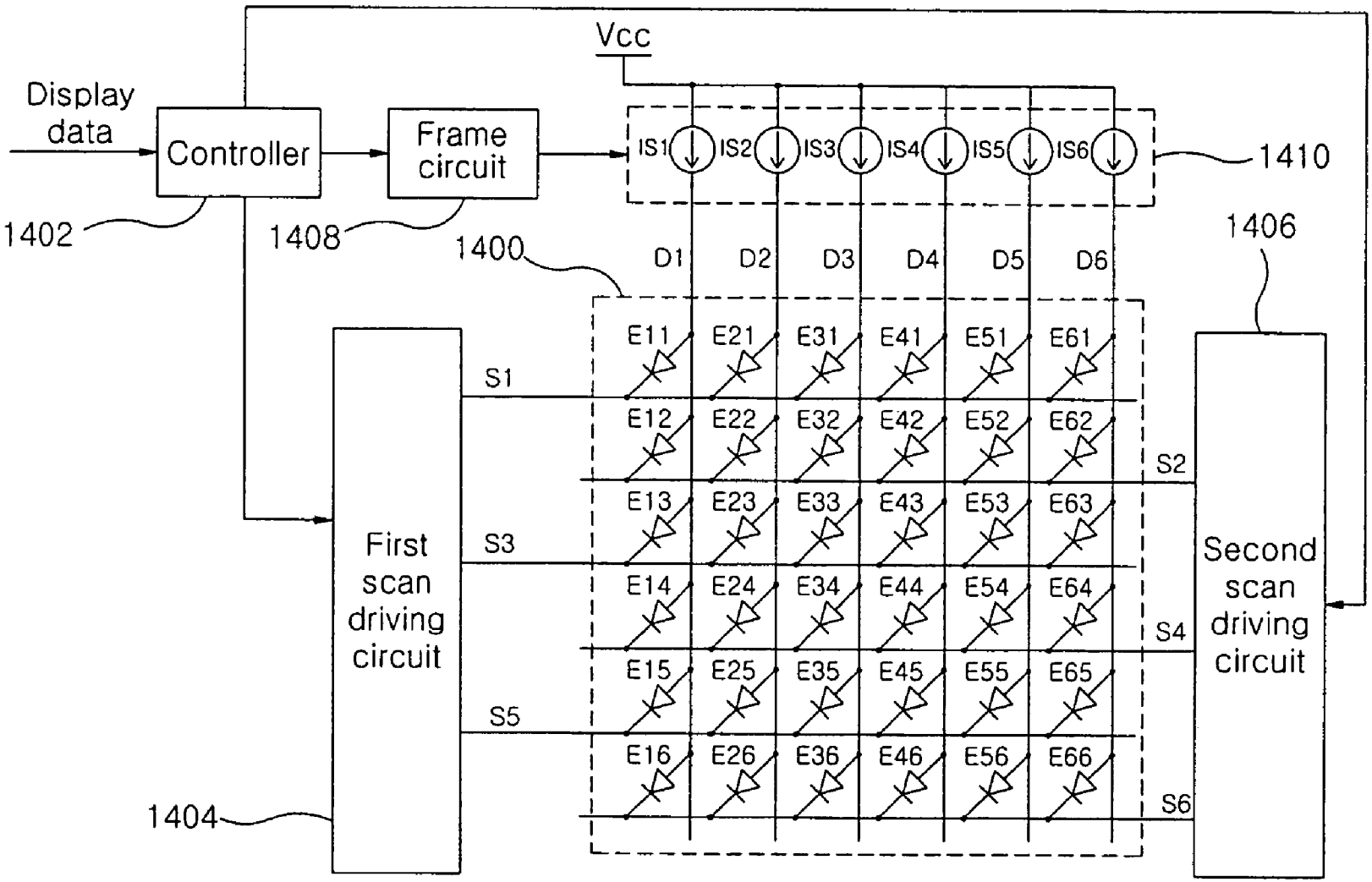
FIG. 22 is a view illustrating a display device according to an example embodiment of the present invention.

FIG. 22 is a view illustrating a display device according to an example embodiment of the present invention. Other embodiments and configurations are also within the scope of the present invention.

As shown in FIG. 22, the display device may include a panel 1400, a controller 1402, a first scan driving circuit 1404, a second scan driving circuit 1406, a frame circuit 1408 and a data driving circuit 1410.

Since elements of this embodiment (except the scan driving circuits 1404 and 1406) are similar to elements described above, a further description of the similar elements will be omitted for ease of discussion.

The first scan driving circuit 1404 may transmit first scan signals to some of the scan lines S1 to S6 (e.g. S1, S3 and S5). The second scan driving circuit 1406 may transmit second scan signals to the other scan lines S2, S4 and S6.

Embodiments of the present invention may provide a display device in which a first line pattern does not occur or is minimized. Embodiments of the present invention may provide a display device in which a cross-talk phenomenon does not occur or is minimized. Embodiments of the present invention may provide a display device in which a second line pattern does not occur at panel or is minimized.

Embodiments of the present invention may convert first display data into second display data during a predetermined frame with reference to a total amount of current passing through a corresponding scan line and a corresponding resistance. Therefore, a first line pattern and a cross-talk phenomenon may not occur at a panel or may be minimized.

Sub-pixels related to outermost data lines may be preset to have a lower gray scale than a predetermined gray scale in a unit of plural frames. Thus, a second line pattern may not occur at a panel or may be minimized.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electroluminescent display device comprising:

a panel having a plurality of scan lines, a plurality of data lines and a plurality of pixels formed at cross areas of the scan lines and the data lines;

a driving circuit to drive scan signals on the scan lines and data signals on the data lines;

a frame circuit control device to receive first display data, to determine an amount of current passing through each of the scan lines for a plurality of frames based on the first display data, and to provide second display data to the driving circuit based on the determined amount of current, wherein the frame circuit control device lowers a brightness level of pixel positioned at a left edge in a first scan line than that of pixel positioned at a right edge in the first scan line, and the frame circuit control device lowers a brightness level of pixel positioned at the right edge in a second scan line than that of pixel positioned at the left edge in the second scan line.

2. The display device of claim 1, wherein the frame circuit control device determines a pattern shape for one scan line based on the determined amount of current for the one scan line.

3. The display device of claim 2, wherein the frame circuit control device determines a level constant for one scan line based on the determined amount of current for the one scan line and the determined pattern shape.

4. The display device of claim 1, wherein the frame circuit control device divides an area of one scan line into a plurality of sub-areas.

5. The display device of claim 1, wherein the frame circuit control device determines one of a pattern, a frame rate and a frame level for one scan line based on the determined amount of current for the one scan line.

6. The display device of claim 1, wherein the frame circuit control device lowers a brightness level of the first display data relating to the one scan line for at least one frame to provide the second display data relating to the one scan line for the at least one frame.

7. The display device of claim 1, wherein the frame circuit control device increases a brightness level of first display data relating to the one scan line for at least one frame to provide the second display data relating to the one scan line for the at least one frame.

8. The display device of claim 1, wherein each of the pixels include a first electrode layer, an organic layer and a second electrode layer.

9. The display device of claim 8, wherein the organic layer comprises an emitting layer to emit light.

10. The display device of claim 1, wherein the pixels include at least three sub-pixels.

11. A display device comprising:

a panel having a plurality of scan lines, a plurality of data lines and a plurality of pixels;

at least one driving circuit to provide scan signals on the scan lines and data signals on the data lines; and a frame circuit control device to receive first display data and determine an amount of current pass through each of the scan lines, the frame circuit control device to alter the first display data for at least one scan line and to provide second display data to the at least one driving circuit based on the determined amount of current for the at least one scan line, wherein the frame circuit control device lowers a brightness level of pixel positioned at a left edge in a first scan line than that of pixel positioned at a right edge in the first scan line, and the frame circuit control device lowers a brightness level of pixel positioned at the right edge in a second scan line than that of pixel positioned at the left edge in the second scan line.

12. The display device of claim 11, wherein the frame circuit device determines a pattern for the at least one scan line based on the determined amount of current for the at least one scan line.

13. The display device of claim 12, wherein the frame circuit device determines a level constant for the at least one scan line based on the determined amount of current for the at least one scan line and the determined pattern for the at least one scan line.

14. The display device of claim 11, wherein the frame circuit device divides the at least one scan line into a plurality of sub-areas.

15. The display device of claim 11, wherein the frame circuit device determines one of a pattern, a frame rate and a frame level for the at least one scan line based on the determined amount of current for at least the one scan line.

16. The display device of claim 11, wherein each of the pixels include a first electrode layer, an organic layer and a second electrode layer.

17. The display device of claim 11, wherein each of the pixels includes at least three sub-pixels.

18. A method of driving an electroluminescent display device having a plurality of scan lines, a plurality of data lines and a plurality of pixels, the method comprising:

receiving first display data;

determining an amount of current passing through each of the scan lines based on the received first display data;

lowering a brightness level of pixel positioned at a left edge in a first scan line than that of pixel positioned at a right edge in the first scan line;

lowering a brightness level of pixel positioned at the right edge in a second scan line than that of pixel positioned at the left edge in the second scan line; and providing the second display data to the scan lines based on the determined amount of current.

19. The method of claim 18, wherein providing the second display data includes determining a pattern for at least one scan line based on the determined amount of current for the at least one scan line.

20. The method of claim 19, wherein providing the second display data includes determining a brightness level of the at least one scan line based on the determined amount of current for the at least one scan line and the determined pattern for the at least one scan line.

21. The method of claim 18, wherein providing the second display data includes dividing a scan line into a plurality of sub-areas.

22. The method of claim 18, wherein providing the second display data includes determining one of a pattern, a frame rate and a frame level for at least one scan line based on the determined amount of current for the at least one scan line.

* * * * *